US007570909B2

(12) United States Patent
Asakura et al.

(10) Patent No.: US 7,570,909 B2
(45) Date of Patent: Aug. 4, 2009

(54) FIXING APPARATUS AND IMAGE FORMING APPARATUS INCLUDING THE SAME

(75) Inventors: Kenji Asakura, Kyoto (JP); Hiroyuki Yamaji, Nara (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 355 days.

(21) Appl. No.: 11/736,608

(22) Filed: Apr. 18, 2007

(65) Prior Publication Data

US 2007/0248389 A1 Oct. 25, 2007

(30) Foreign Application Priority Data

Apr. 21, 2006 (JP) ..... 2006-118512

(51) Int. Cl.
*G03G 15/20* (2006.01)

(52) U.S. Cl. ..... 399/328

(58) Field of Classification Search ..... 219/216; 399/320, 328, 329
See application file for complete search history.

(56) References Cited

U.S. PATENT DOCUMENTS 7,010,255 B2 * 3/2006 Yura et al. ..... 399/328
7,194,233 B2 * 3/2007 Wu et al. ..... 399/328

FOREIGN PATENT DOCUMENTS

| | | |
|---|---|---|
| JP | 52-151031 | 12/1977 |
| JP | 11-065336 | 3/1999 |
| JP | 2003-345084 | 12/2003 |
| JP | 2004-109481 | 4/2004 |
| JP | 2004-198659 | 7/2004 |
| JP | 2005-062554 | 3/2005 |
| JP | 2005-148311 | 6/2005 |
| JP | 2005-215238 | 8/2005 |
| JP | 2005-266415 | 9/2005 |

* cited by examiner

*Primary Examiner*—Hoang Ngo
(74) *Attorney, Agent, or Firm*—Renner, Otto, Boisselle & Sklar, LLP

(57) ABSTRACT

In a fixing apparatus including a regulating member which regulates the position of an external heating belt in a rotation axis direction, the external heating belt includes a base material made of polyimide having a tensile strength of 300 MPa or more and a thickness of 50 μm to 200 μm, and a releasing layer. In the base material, 5 to 25 parts by weight of graphite is dispersed in 100 parts by weight of polyimide. With this, it is possible to improve the durability of the external heating belt and adequately secure the life of the external heating belt.

13 Claims, 6 Drawing Sheets

FIXING APPARATUS AND IMAGE FORMING APPARATUS INCLUDING THE SAME

This Nonprovisional application claims priority under 35 U.S.C. § 119(a) on Patent Application No. 118512/2006 filed in Japan on Apr. 21, 2006, the entire contents of which are hereby incorporated by reference.

FIELD OF THE INVENTION

The present invention relates to (i) a fixing apparatus used in an electrophotographic image forming apparatus and (ii) an electrophotographic image forming apparatus using the fixing apparatus.

BACKGROUND OF THE INVENTION

Conventionally, as a fixing apparatus used in an electrophotographic image forming apparatus such as a copying machine, a printer, and the like, the following type of fixing apparatus has generally been used. Specifically, this conventionally-used fixing apparatus (heat roller fixing apparatus) includes a fixing roller and a pressing roller which are pressed against each other, wherein heating means constituted of a halogen lamp (halogen heater) disposed in the fixing roller or halogen lamps (halogen heaters) disposed in both of the rollers heat(s) the pair of rollers at a predetermined temperature (fixing temperature), and a recording paper on which an unfixed toner image is formed is fed to a pressing section (fixing nip section) of the pair of rollers, and the recording paper is allowed to pass through the pressing section so as to fix the toner image by heat and pressure.

In a fixing apparatus provided in a color image forming apparatus, it is general to use an elastic roller having an elastic layer which is made of silicone rubber or the like and which is provided on a fixing roller surface layer.

The elastic roller is used as the fixing roller, so that the fixing roller surface is elastically deformed corresponding to an uneven surface of the unfixed toner image and is in contact with the toner image so as to cover the toner image. This allows the color unfixed toner image whose toner amount is larger than that of monochrome to be favorably heated and fixed. Further, due to strain release of the elastic layer which occurs in the fixing nip section, it is possible to improve a releasing property with respect to color toner which is more likely to be offset than monochrome toner. Further, a nip shape of the fixing nip section has a concave upward (on the side of the fixing roller) (that is, the nip shape is a so-called inverse nip shape), so that it is possible to more favorably strip paper. As a result, it is possible to strip paper without using any stripping means such as a stripping protrusion (self stripping), so that it is possible to prevent insufficient image formation which is caused by the stripping means.

Note that, an image forming apparatus using monochrome toner is also arranged so that the elastic layer is provided only on the pressing roller without being provided on the fixing roller so as to secure the fixing nip.

Incidentally, the fixing roller or the pressing roller which includes the elastic layer raises the following problem. In the fixing roller having the elastic layer, the elastic layer cannot sufficiently conducts heat. Thus, in case where the heating means is provided in the fixing roller, heat is less efficiently conducted, so that it takes longer time to warm up. In case of allowing sheets to sequentially pass at high speed, the temperature of the fixing roller drops.

As a method for solving these problems, a technique in which external heating means is brought into contact with the fixing roller surface so that the fixing roller is heated from the outside (external heat fixing process) is known.

For example, Patent Document 1 (Japanese Unexamined Patent Publication No. 198659/2004 (Tokukai 2004-198659) (Publication date: Jul. 15, 2004)) proposes a technique (an external belt heat fixing process) using an external heating belt (endless belt), suspended by belt suspending rollers, as external heating means. In this technique, the external heating belt is used as the external heating means, so that a contact area between the external heating means and the fixing roller increases, thereby promoting supply of heat from the external heating means to the fixing roller.

Moreover, Patent Document 2 (Japanese Unexamined Patent Publication No. 345084/2003 (Tokukai 2003-345084) (Publication date: Dec. 3, 2003)) discloses a technique of dispersing graphite in a polyimide belt having a thickness of 5 μm to 500 μm, as a fixing belt or a transfer belt.

Moreover, Patent Document 3 (Japanese Unexamined Patent Publication No. 215238/2005 (Tokukai 2005-215238 (Publication date: Aug. 11, 2005)) discloses an endless belt formed by applying a release layer in such a state that the ratio of imidization of a heat-resistant resin layer is 20% to 70%, and burning it.

However, in the technique of Patent Document 1, the external heating belt is heated by heating the belt suspending rollers and heat is supplied to the fixing member via the external heating belt, so that it is necessary to set temperature of each of the belt suspending rollers and the external heating belt to be higher than the surface temperature of the fixing roller. Thus, also after stopping the heating of the belt suspending rollers, each belt suspending roller has higher temperature than the surface temperature of the fixing roller for a while. As a result, when the rotation of the fixing roller is stopped at the time of fixing-standby after finishing the fixing, a contact portion between the fixing roller and the external heating belt (particularly, a portion being in contact with the belt suspending roller via the external heating belt) is locally heated, so that the surface of the fixing roller has uneven temperature, which results in uneven gloss of an image.

Moreover, in the technique of Patent Document 1, the regulation of position of the belt in an axis direction is carried out by adjusting the parallelism of the roller. To regulate the position of the belt by actively adjusting the parallelism of the roller, detection and feedback control are required. This increases the complexity of the apparatus.

Patent Document 1 describes that the polyimide belt is used as the external heating belt, but does not adequately describe the material or strength of the polyimide belt, or an arrangement for securing an adequate life of the belt along with a simple method for regulating the position of the belt.

Moreover, Patent Document 2 discloses an addition of an additive to give electrical conductivity and/or heat conductivity to a polyimide resin belt. However, this belt is used as a fixing belt or a transfer belt. Therefore, Patent Document 2 does not disclose an arrangement for securing an adequate life of a belt which is used as the external heating belt for the fixing member and has a simple arrangement.

SUMMARY OF THE INVENTION

The present invention was made to solve the above problems, and an object of the present invention is to improve the durability of an external heating belt and adequately secure the life of the external heating belt, in a fixing apparatus including the regulating member which regulates the position of the external heating belt in a rotation axis direction.

To achieve the above object, a fixing apparatus of the present invention includes: a fixing member and a pressing member, at least one of which is a heated member; and an external heating device which (i) heats a belt rotatably suspended by a plurality of support rollers, at least one of which includes therein a heat source and (ii) causes the belt to contact a peripheral surface of at least one of the fixing member and the pressing member to heat the heated member, the fixing member and the pressing member sandwiching and transporting a recording material so that an unfixed image on the recording material is fixed on the recording material, the fixing apparatus further including a regulating member which (i) is provided outside, in an axis direction of the support roller, a facing portion of the support roller which portion faces the heated member, and (ii) contacts a side portion of the belt to regulate the position of the belt in the axis direction, the belt including a base material made of polyimide having a tensile strength of 300 MPa or more and a thickness of 50 μm to 200 μm, and a releasing layer on a surface of the base material, and in the base material, 5 to 25 parts by weight of graphite being dispersed in 100 parts by weight of polyimide.

According to the above arrangement, the belt of the external heating device includes (i) the base material made of polyimide having the tensile strength of 300 MPa or more and the thickness of 50 μm to 200 μm, and (ii) a releasing layer on the outermost surface of the base material. In addition, in the base material, 5 to 25 parts by weight of graphite is dispersed in 100 parts by weight of polyimide. Therefore, it is possible to improve the durability of the belt and adequately secure the life of the belt.

To control the temperature of the heated member to a certain temperature when consecutively outputting the recording materials, the temperature of the belt needs to be equal to or higher than the temperature (the above certain temperature) of the heated member so that heat is continuously supplied from the belt to the heated member. Here, the support roller which supplies heat to the belt and includes therein the heat source is further higher in temperature. If the fixing apparatus is stopped suddenly in this state, the temperature of a portion of the belt which portion contacts the support roller including therein the heat source becomes high, and may exceed the melting points of the belt and the heated member. In such a case, heat deterioration occurs on the surfaces of the belt and the heated member, smooth rotation of the belt and heat conduction to the heated member deteriorate, and uneven fixation occurs on a fixed image.

However, according to the arrangement of the present invention, as the base material of the belt, 5 parts by weight or more of graphite is added to 100 parts by weight of polyimide. This improves the heat conductivity of the belt. Thus, it is possible to lower the temperature of the moving support roller (heat roller) including therein the heat source. Therefore, even if the operation of the fixing apparatus is stopped suddenly, the temperature does not exceed the melting points of the surfaces of the belt and the heated member. On this account, the heat deterioration does not occur on the surface of the belt or the heated member, and it is possible to improve the durability of the belt. Therefore, it is possible to cause the belt to smoothly rotate for a long period of time, not to lower the heat conduction to the heated member, and to prevent the occurrence of the uneven fixation.

In a case where more than 25 parts by weight of graphite is added to 100 parts by weight of polyimide in the belt, mechanical flexibility of the belt deteriorates. In this case, cracking occurs on the surface of the base material when the belt is rotated consecutively, and the durability of the belt is insufficient.

Moreover, by adding 1 part by weight or more of graphite, it is possible to give electrical conductivity of 10 Ω/cm to 12 Ω/cm to the base material of the belt. Each of the surfaces of the belt and the heated member heated by the belt is made of an insulating material (for example, fluorocarbon resin), not including any additive, to improve the releasing property. Therefore, friction electricity is generated on the surfaces of the belt and the heated member, heated by the belt, by rotations of the belt and the heated member which contact each other. Moreover, since the belt rotates while contacting the support roller, friction electricity is generated also on an inner surface (a surface contacting the support roller) of the belt. When graphite is not added to polyimide, the surface potential of the belt becomes 1 kV or more. However, by adding graphite, it is possible to prevent the charging of the belt. When the belt is charged, the charged developer or paper powder adheres to the belt. If these deposits stack, the heat conduction from the belt is blocked. However, according to the arrangement of the present invention, since it is possible to prevent the charging and the heat conduction does not lower, it is possible to effectively transfer heat to the heated member.

Moreover, when the thickness of the base material of the belt is less than 50 μm, the strength of the belt is low, and the durability of the belt is insufficient. Moreover, when the thickness of the base material exceeds 200 μm, the stiffness of the belt is too high, and the belt does not sufficiently wind around the support rollers unless the belt is pulled by the support rollers by high tension. If the belt does not wind around the support rollers sufficiently, the belt and the support rollers slip while rotating. If the belt and the support rollers slip, the inner surface of the belt abrades away, and the strength of the belt becomes low. Moreover, since a contact area between the belt and each support roller becomes small, the heat conduction from the support roller to the belt deteriorates. Therefore, to maintain the surface temperature of the belt at a constant temperature, it is necessary to increase the temperature of the support roller. Thus, when the belt is stopped suddenly, the temperature of the belt increases, and the releasing layer on the surface deteriorates by heat. However, according to the arrangement of the present invention, since the thickness of the base material of the belt is from 50 μm to 200 μm, it is possible to stably heat the heated member without the deterioration of the belt.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*a*) illustrates a state in which support rollers are in a first position. FIG. 1(*b*) illustrates a state in which the support rollers are in a second position.

FIG. 4(*b*) is a cross sectional view of the belt release/contact operating device.

FIG. 5(*b*) is a cross-sectional view illustrating the arrangement of only the support roller. FIG. 5(*c*) is an enlarged view of FIG. 5(*b*). FIG. 5(*d*) is an enlarged view illustrating the vicinity of the support roller and a position regulating member.

FIG. 6(*a*) illustrates a case where support rollers are in the first position. FIG. 6(*b*) illustrates a case where the support rollers are in the second position.

DESCRIPTION OF THE EMBODIMENTS

Embodiment 1

Figure 2:
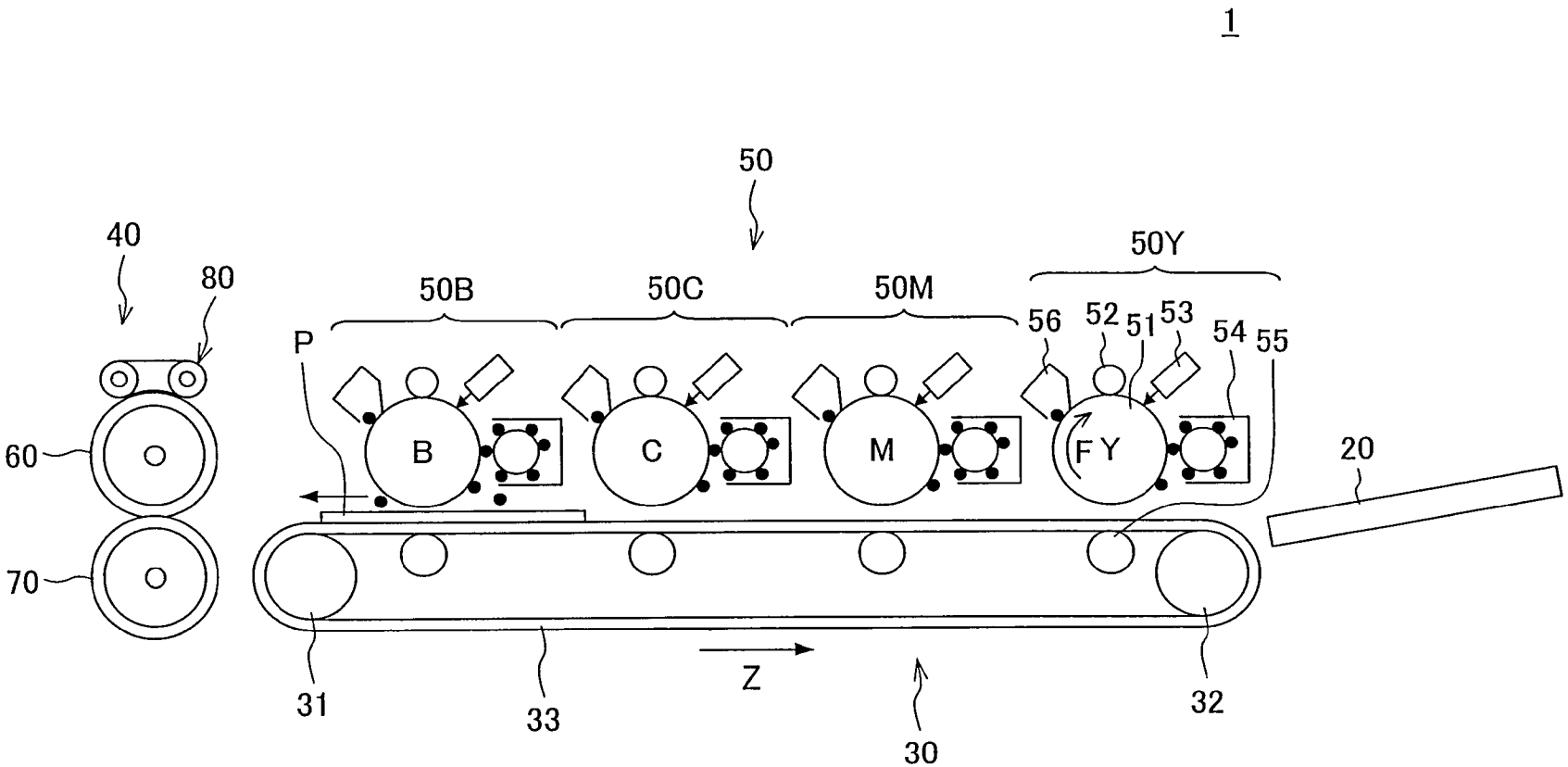
FIG. 2 is an explanatory drawing which illustrates an arrangement of an image forming apparatus including the fixing apparatus according to one embodiment of the present invention.

One embodiment of the present invention is described as follows. First, with reference to FIG. 2, an image forming apparatus 1 including a fixing apparatus of the present embodiment is described. FIG. 2 is a schematic illustrating an internal arrangement of the image forming apparatus 1. The image forming apparatus 1 is a dry electrophotographic color image forming apparatus and serves as a printer which forms a color image or a monochrome image onto a sheet (recording material, transfer medium, recording sheet) P in accordance with image data sent from each terminal device connected via a network or image data scanned by a scanner.

The image forming apparatus 1 is a dry electrophotographic and quadruple tandem type color printer and includes a visible image transfer section 50, a sheet transport section 30, a fixing apparatus 40, a sheet feeding tray 20.

The visible image transfer section 50 includes a yellow image transfer section 50Y, a magenta image transfer section 50M, a cyan image transfer section 50C, and a black image transfer section 50B. These are specifically arranged as follows: between the sheet feeding tray 20 and the fixing apparatus 40, the yellow image transfer section 50Y, the magenta image transfer section 50M, the cyan image transfer section 50C, and the black image transfer section 50B are provided in this order from the side of the sheet feeding tray 20.

The transfer sections 50Y, 50M, 50C, and 50B are arranged substantially in the same manner, and respectively transfer a yellow image, a magenta image, a cyan image, and a black image onto the sheet P in accordance with the image data.

Each of the transfer sections 50Y, 50M, 50C, and 50B includes a photosensitive drum 51, and is arranged so that a charging roller 52, an LSU (laser beam scanner unit) 53, a developing unit 54, a transfer roller 55, and a cleaning device 56 are provided around the photosensitive drum 51 so as to be along a rotational direction of the photosensitive drum 51 (direction F in FIG. 2).

The photosensitive drum 51 of each of the transfer sections 50Y, 50M, 50C, and 50B is a drum-shape transfer roller whose surface is made of a photosensitive material and is rotated in the direction F. The charging roller 52 uniformly (evenly) charges the surface of the photosensitive drum 51.

LSUs 53 of the transfer sections 50Y, 50M, 50C, and 50B respectively receive pixel signals corresponding to a yellow component, a magenta component, a cyan component, and a black component of the image data respectively. Each LSU 53 exposes the charged photosensitive drum 51 and forms an electrostatic latent image in accordance with each pixel signal.

Developing units 54 of the transfer sections 50Y, 50M, 50C, and 50B respectively include yellow toner, magenta toner, cyan toner, and black toner (developer). Further, each developing unit 54 develops the electrostatic latent image formed on the photosensitive drum 51 with the toner so as to form a toner image (visualized image). Note that, examples of the toner include nonmagnetic monocomponent developer (nonmagnetic toner), nonmagnetic bicomponent developer (nonmagnetic toner and carrier), magnetic developer (magnetic toner), and the like.

The toner is prepared by adding fine particles of silica or titanium dioxide to matrix resin in which (i) polyester or styrene acryl is used as a binder, and (ii) pigments as a coloring agent and a WAX as a release agent are dispersed. In the present embodiment, the melting point (of the matrix resin) of the toner is 120° C. It is preferable that the melting point of the toner be from 100° C. to 140° C. If the melting point of the toner is lower than 100° C., the flowability of the toner decreases due to stress in the developing unit 54 or increase in the temperature inside the developing unit 54, and the flowability and delivery necessary at the time of development cannot be obtained. Moreover, if the melting point of the toner exceeds 140° C., the temperature of an endless belt 83 (described later) exceeds the melting point of fluorocarbon resin that is the releasing layer on the outermost surface of the endless belt 83. Therefore, it is impossible to realize an external heating arrangement using, as the releasing layer, fluorocarbon resin having excellent releasing property.

To each of transfer rollers 55 of the transfer sections 50Y, 50M, 50C, and 50B, a bias voltage whose polarity is opposite to the toner is applied, and the transfer roller 55 applies the bias voltage to the sheet P so that the toner image formed on the photosensitive drum 51 is transferred onto the sheet P.

Each of cleaning devices 56 of the transfer sections 50Y, 50M, 50C, and 50B removes toner remaining on the photosensitive drum 51 after transferring the image onto the sheet P. This transfer of the toner image onto the sheet P is repeated four times corresponding to four colors.

The sheet transport section 30 includes a driving roller 31, an idling roller 32, and a transfer belt 33, and transports the sheet P so that the toner image is formed on the sheet P by the transfer sections 50Y, 50M, 50C, and 50B sequentially.

The driving roller 31 and the idling roller 32 suspend the transfer belt 33. The driving roller 31 is controlled so as to rotate at a predetermined peripheral speed (in the present embodiment, 355 mm/s in forming a monochrome image (monochrome mode) and 175 mm/s in forming a color image (color mode)), so that the transfer belt 33 rotates.

The transfer belt 33 is suspended between the driving roller 31 and the idling roller 32 so as to be in contact with the photosensitive drums 51 of the transfer sections 50Y, 50M, 50C, and SOB, and the transfer belt 33 is frictionally driven in a direction Z by the rollers 31 and 32. Further, the transfer belt 33 electrostatically adsorbs the sheet P transported from the sheet feeding tray 20 and transports the sheet P to the transfer sections 50Y, 50M, 50C, and 50B sequentially.

Further, the sheet P on which the toner image has been transferred by the transfer sections 50Y, 50M, 50C, and 50B is stripped from the transfer belt 33 due to a curvature of the driving roller 31 and is transported to the fixing device 40. Note that, the toner image which has been transferred to the sheet P by the transfer sections 50Y, 50M, 50C, and 50B is still unfixed on the sheet P at this stage.

The fixing apparatus 40 thermally fixes the unfixed toner image, which has been transferred onto the sheet P, onto the sheet P. Specifically, the fixing apparatus 40 includes a fixing roller (fixing member) 60 and a pressing roller (pressing member) 70. The sheet P which has been transported from the visible image transfer section 50 at a predetermined transport speed (process speed: 355 mm/s in the monochrome mode and 175 mm/s in the color mode) and a predetermined copying speed (the number of copied sheets in every one minute: 70 sheets/minute at the time of horizontal transport of A4 sheets in the monochrome mode, 40 sheets/minute at the time of horizontal transport of A4 sheets in the color mode) is transported into the fixing nip section formed between the fixing roller 60 and the pressing roller 70. Further, the sheet P is further transported by the fixing roller 60 and the pressing roller 70 with it sandwiched by the fixing roller 60 and the pressing roller 70. At this time, the toner image (unfixed toner image) on the sheet P is fused by heat of a peripheral surface of the fixing roller 60 and is pressed by the fixing roller 60 and the pressing roller 70 so as to be fixed as a rigid image on the sheet P.

Further, the sheet P on which the toner image has been fixed by the fixing apparatus 40 is delivered to an external sheet delivery tray (not shown) of the image forming apparatus 1. In this manner, the image forming process is finished. Note that, a specific arrangement of the fixing apparatus 40 will be detailed later.

Further, the image forming apparatus 1 can carry out a color mode (multicolor mode) process in which the transfer sections 50Y, 50M, 50C, and 50B transfer an image onto the sheet P so as to form a color image (multicolor image) and can carry out a monochrome mode (black-and-white mode) process in which only the black transfer section 50B transfers an image onto the sheet P so as to form a monochrome image (black-and-white image). Specifically, in response to an instruction inputted by the user, a control section (a controlling integrated circuit substrate or a computer: not shown) provided in the image forming apparatus 1 selects either the color mode or the monochrome mode and controls the transfer sections 50Y, 50M, 50C, and 50B so as to carry out image formation according to the selected mode.

Further, the control section controls sheet transport means (the sheet transport section 30, the fixing roller 60, the pressing roller 70, and the like) of the image forming apparatus 1 so as to transport the sheet P at the transport speed of 355 mm/s in the color mode and so as to transport the sheet P at the transport speed of 175 mm/s in the monochrome mode.

Figure 3:
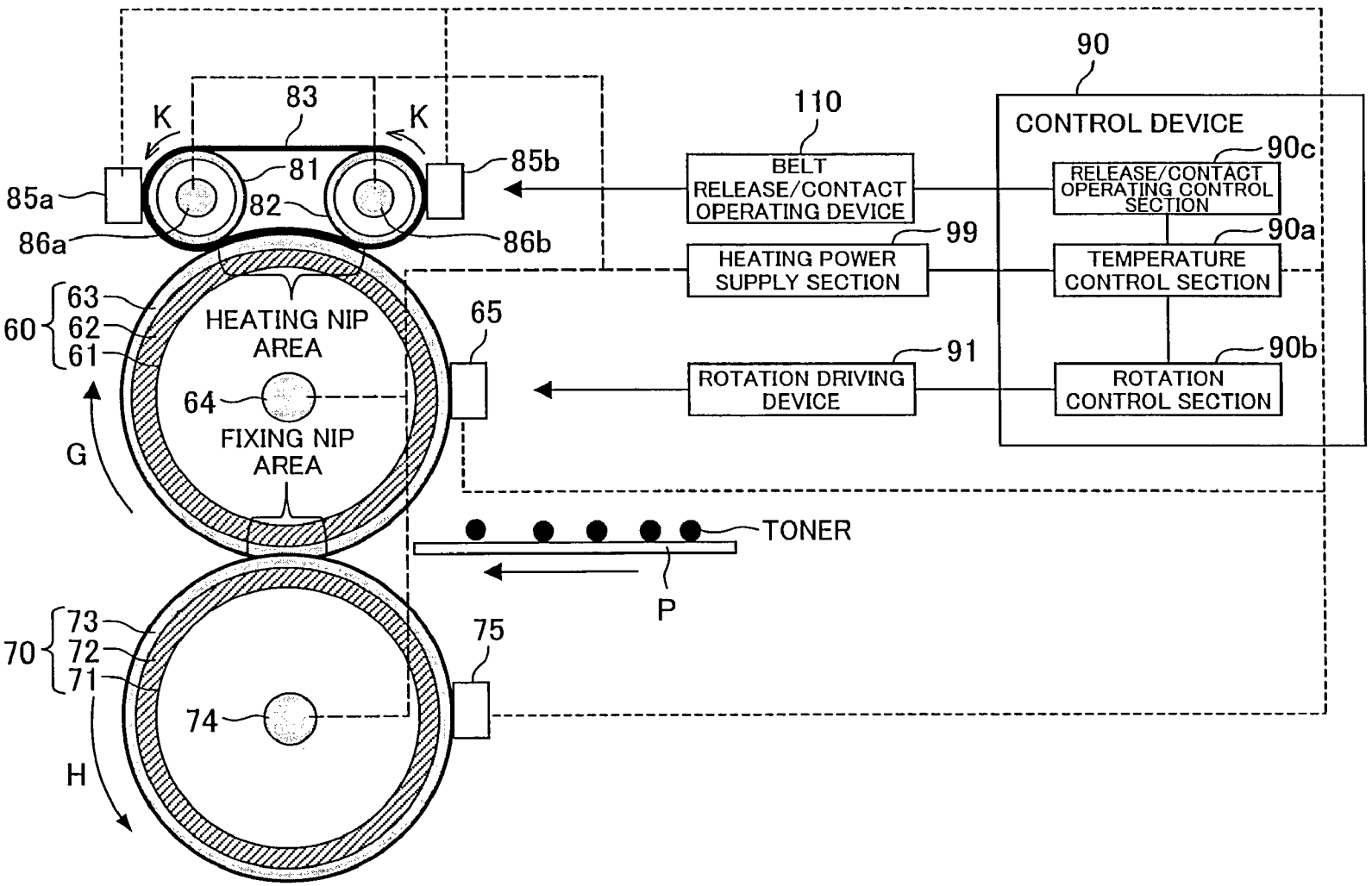
FIG. 3 is an explanatory drawing which illustrates an arrangement of the fixing apparatus according to one embodiment of the present invention.

Next, the fixing apparatus 40 is specifically described as follows. FIG. 3 is a schematic illustrating an arrangement of the fixing apparatus 40. The fixing apparatus 40 includes not only the aforementioned fixing roller 60 and pressing roller 70 but also an external heating device 80, a control device 90, a rotation driving device 91, and a belt release/contact operating device 110. Note that, a web cleaning device and/or the like may be additionally provided so as to clean the surface of the fixing roller 60.

The rotation driving device 91 rotationally drives the fixing roller 60 and includes a motor and the like for example. Note that, the operation of the rotation driving device 91 is controlled by the control device 90.

The fixing roller 60 is a roller which rotates in a direction G shown in FIG. 3, and includes a hollow cylindrical metal core 61, an elastic layer 62 covering an external peripheral surface of the core 61, and a releasing layer 63 covering the elastic layer 62.

The metal core 61 is made of aluminum whose external diameter is 46 mm and has a cylindrical shape. Note that, the metal core 61 is not limited to aluminum, and may be made of iron, stainless steel, and the like for example. The elastic layer 62 has the thickness of 3 mm and is made of silicone rubber having heat resistance (JIS-A hardness of 20). The releasing layer 63 is made of a PFA (copolymer of tetrafluoroethylene and perfluoroalkylvinylether) tube whose thickness is about 30 μm. Note that, the material of the releasing layer 63 is not particularly limited as long as the material has excellent heat resistance, durability, and releasing property with respect to the toner. Instead of PFA, a fluorine material such as PTFE (polytetrafluoroethylene) and the like may be used. The fixing roller 60 arranged in this manner has an external diameter of 50 mm, and a surface hardness of the fixing roller 60 is 68 (ascar C). Note that, the surface of the fixing roller 60 has a width of 320 mm in the rotation axis direction.

A thermistor 65 for detecting temperature of a peripheral surface of the fixing roller 60 is in contact with the peripheral surface, and a halogen lamp (heater lamp) 64 for carrying out heat radiation by receiving power is provided in the metal core 61. The halogen lamp 64 serves as a heat source of the fixing roller 60. When power is supplied to the halogen lamp 64, the halogen lamp 64 heats the inside of the fixing roller 60 to a predetermined temperature (180° C. in the present embodiment) so as to heat the sheet P which passes through the fixing nip section and has the unfixed toner image thereon.

Note that, in the present embodiment, a single halogen lamp 64 is internally provided, but the present invention is not limited to this arrangement. A plurality of halogen lamps whose heat generation distribution is divided in the rotation axis direction may be used so that it is possible to realize optimal temperature distribution according to a sheet size for example. Further, in the present embodiment, the thermistor 65 is disposed so as to be in contact with a central portion of the fixing roller 60 so that the central portion is in a longer side direction, but the present invention is not limited to this arrangement. The thermistor 65 may be disposed in an end (an area where no sheet passes) of the fixing roller 60 so that the end is in the longer side direction. Further, in case where the central portion and the end portion are different from each other in a heat value because two halogen lamps are disposed or in a similar case, the thermistors may be provided on both the central portion and the end portion.

The pressing roller 70 is a roller which rotates in a direction H of FIG. 3 and includes a hollow metallic cylindrical metal core 71, an elastic layer 72 covering an external peripheral surface of the metal core 71, and a releasing layer 73 covering the elastic layer 72.

The metal core 71 has an external diameter of 46 mm and is made of aluminum. Note that, the metal core 71 is not limited to aluminum and may be made of iron, stainless steel, and the like. The elastic layer 72 is made of a silicone rubber whose thickness is 2 mm and which has heat resistance. The releasing layer 73 is made of a PFA tube whose thickness is about 30 μm. Note that, the material of the releasing layer 73 is not particularly limited as long as the material has excellent heat resistance, durability, and releasing property with respect to the toner. Instead of PFA, a fluorine material such as PTFE may be used. The pressing roller 70 arranged in this manner has an external diameter of 50 mm, and a surface hardness of the pressing roller 70 is 75 (ascar C).

The pressing roller 70 is pressed against the fixing roller 60 by an elastic member (spring: not shown) with a predetermined load (600 N in this arrangement). As a result, a fixing nip section (a portion at which the fixing roller 60 and the pressing roller 70 are in contact with each other, the portion has a width of 9 mm in a sheet transport direction) is formed between the peripheral surface of the fixing roller 60 and the peripheral surface of the pressing roller 70. The pressing roller 70 is rotated by the fixing roller 60 so as to rotate in a direction opposite to a rotational direction of the fixing roller 60 (at the fixing nip section, moving directions of both of the rollers are the same). Note that, in the present embodiment, the pressing roller 70 is rotated by the fixing roller 60, but the present invention is not limited to this arrangement. It may be so arranged that the pressing roller 70 is rotated by rotation driving means which is different from the fixing roller 60.

Further, a thermistor 75 for detecting temperature of a peripheral surface of the pressing roller 70 is in contact with the peripheral surface, and a halogen lamp (heater lamp) 74 for carrying out heat radiation by receiving power is provided in the metal core 71. The halogen lamp 74 serves as a heat source of the pressing roller 70. When power is supplied to the halogen lamp 74, the inside of the pressing roller 70 is heated to a predetermined temperature (150° C. in the present embodiment).

Note that, in the present embodiment, a rubber hardness (75) of the pressing roller 70 is higher than a rubber hardness (68) of the fixing roller 60. This arrangement is made so that the fixing nip section formed between the pressing roller 70 and the fixing roller 60 has an inverse nip shape (the shape of the pressing roller 70 hardly changes and the fixing roller 60 has a slightly concave shape). A nip width (a width of the fixing roller 60 in a circumferential direction) of the fixing nip section obtained in this manner is 8.5 mm in the present embodiment.

A reason for which the fixing nip section N between the pressing roller 70 and the fixing roller 60 has the inverse nip shape is explained as follows. In case where the fixing nip section N has the inverse nip shape, the sheet P passing through the fixing nip section N is delivered in a direction along the peripheral surface of the pressing roller 70, so that the sheet P is more easily stripped by itself in being delivered from the fixing nip section N (the sheet P is more likely to be stripped due to its elasticity without using any forcible stripping auxiliary means such as a stripping protrusion). Note that, if the surface hardness of the pressing roller 70 is lower than the surface hardness of the fixing roller 60, the fixing nip section N between the fixing roller 60 and the pressing roller 70 is in such a state that the shape of the fixing roller 60 hardly changes and the pressing roller 70 has a slightly concave shape, and the sheet P passing through the fixing nip section N is delivered in a direction along the peripheral surface of the fixing roller 60. As a result, the self stripping hardly occurs.

The external heating device 80 includes a first support roller (first heating roller) 81, a second support roller (second heating roller) 82, an endless belt (belt, external heating belt) 83, a belt release/contact operating device 110 (not shown in FIG. 3), and belt regulating members (regulating members) 121 and 122 (not shown in FIG. 3). Note that in the following explanation, the first support roller 81 and the second support roller 82 are simply referred to as the support roller 81/82 when it is not necessary to distinguish the first support roller 81 and the second support roller 82.

The endless belt 83 is suspended by the support rollers 81 and 82 so that its rear side (internal peripheral surface) is in contact with peripheral surfaces of the support rollers 81 and 82. The endless belt 83 is provided on the fixing roller 60 so as to be positioned in the upstream side of the fixing nip section. When the support rollers 81 and 82 are in a below-described first position, the endless belt 83 is pressed against the fixing roller 60 with a predetermined pressure (40 N in the present embodiment). Thus, a heating nip area (a contact portion between the endless belt 83 and the fixing roller 60: the fixing roller 60 has a width of 20 mm in a circumferential direction) is formed between the fixing roller 60 and the endless belt 83.

When the width of the fixing roller 60 is 32 cm and the pressure (contact force) is 40 N, the pressure per 1 cm is 1.25 N. In the present embodiment, since there are two support rollers, the pressure per 1 cm of one support roller is 0.625 N. Thus, the support rollers contact the fixing roller 60 via the endless belt 83. It is preferable that the contact force of the support roller 81/82 contacting the fixing roller 60 via the endless belt 83 be from 0.25 N to 5 N per 1 cm of each support roller.

When the support rollers 81 and 82 contact the fixing roller 60, the endless belt 83 contacts the external peripheral surface of the fixing roller 60 along the external peripheral surface of the fixing roller 60. The stronger the frictional force between the endless belt 83 and the fixing roller 60 and the frictional force between the endless belt 83 and the support roller 81/82 are, the stronger a meandering force of the endless belt 83 becomes. A portion where these frictional forces become strong is a portion where the support roller 81/82 contacts the fixing roller 60 via the endless belt 83. Therefore, it is preferable to define the contact force of the support roller 81/82 contacting the fixing roller 60. When the contact force is from 0.25 N to 5 N per 1 cm of each support roller, the support roller 81/82 can satisfactorily contact the fixing roller 60 via the endless belt 83 without the slipping of the endless belt 83 or the bending of the support roller 81/82. Since it is impossible to accurately measure a contact area which is on the endless belt 83 and exists between the support rollers 81 and 82, the contact force is defined by dividing the pressure, as a line pressure, by the length in the width direction.

Further, the endless belt 83 comes into contact with the peripheral surface of the rotating fixing roller 60, so that the endless belt 83 is rotated by the fixing roller 60. As a result, the support rollers 81 and 82 rotate in a direction (direction K of FIG. 3) opposite to the rotational direction of the fixing roller 60. That is, when the control device 90 controls the rotation driving device 91 of the fixing roller 60 so as to rotate the fixing roller 60, a frictional force at a portion in which the endless belt 83 and the fixing roller 60 are in contact with each other causes the endless belt 83 to be moved by the fixing roller 60, so that the support rollers 81 and 82 and the endless belt 83 rotate.

The endless belt 83 is obtained by coating a surface of a polyimide base material (product of UBE INDUSTRIES, LTD., product name: Upilex S), whose thickness is 100 μm, with a fluorine resin obtained by blending PETE and PFA with each other as a releasing layer whose thickness is 20 μm. Further, in the base material, 10 parts by weight of graphite is dispersed in 100 parts by weight of polyimide.

In the base material, it is preferable that 5 to 25 parts by weight of graphite be dispersed in 100 parts by weight of polyimide. By adding 5 parts by weight or more of graphite, the heat conductivity improves, and the temperature of the heat roller during operation decreases. Therefore, it is possible to prevent the temperature of the surface of the belt from exceeding the melting point of PFA even when the belt is stopped suddenly. When more than 25 parts by weight of graphite is added to the belt, the mechanical flexibility of the belt deteriorates. In this case, cracking occurs on the surface of the base material when the belt is rotated consecutively. Thus, the durability of the belt is insufficient.

Moreover, by adding 1 part by weight or more of graphite, it is possible to give the electrical conductivity of 10 Ω/cm to 12 Ω/cm to the base material of the endless belt 83. Each of the surfaces of the endless belt 83 and the fixing roller 60 is made of an insulating material, not including any additive, to improve the releasing property. Therefore, friction electricity is generated on the surfaces of the endless belt 83 and the fixing roller 60 by rotations of the endless belt 83 and the fixing roller 60 which contact each other. Moreover, since the endless belt 83 rotates while contacting the support rollers 81 and 82, friction electricity is generated also on an inner surface (a surface contacting the support roller) of the endless belt 83. When graphite is not added to polyimide, the surface potential of the endless belt 83 becomes 1 kV or more. However, by adding graphite, it is possible to prevent the charging of the endless belt 83. When the endless belt 83 is charged, the charged toner or paper powder adheres to the endless belt 83. If these deposits stack, the heat conduction from the endless belt 83 is blocked. However, in the present embodiment, since it is possible to prevent the charging and the heat conduction does not lower, it is possible to effectively transfer heat to the fixing roller 60.

The thickness of the base material of the endless belt 83 is not limited to the above numerical value, and is preferably from 50 μm to 200 μm. When the thickness of the base material of the endless belt 83 is less than 50 μm, the strength of the endless belt 83 is low, and the durability of the endless belt 83 is insufficient. Moreover, when the thickness of the base material exceeds 200 μm, the stiffness of the endless belt 83 is too high, and the endless belt 83 does not sufficiently wind around the support rollers 81 and 82 unless the endless belt 83 is pulled by the support rollers 81 and 82 by high tension. If the endless belt 83 does not wind around the support rollers 81 and 82 sufficiently, the endless belt 83 and the support rollers slip while rotating. If the endless belt 83 and the support rollers 81 and 82 slip, the inner surface of the endless belt 83 abrades away, and the strength of the endless belt 83 becomes low. Moreover, since a contact area between the endless belt 83 and the support roller 81/82 becomes small, the heat conduction from the support roller 81/82 to the endless belt 83 deteriorates. Therefore, to maintain the surface temperature of the endless belt 83 at a constant temperature, it is necessary to increase the temperature of the support roller. Thus, when the endless belt 83 is stopped suddenly, the temperature of the endless belt 83 increases, and the releasing layer on the surface deteriorates by heat. However, in the present embodiment, since the thickness of the base material of the endless belt 83 is from 50 μm to 200 μm, it is possible to stably heat the heated member without the deterioration of the endless belt 83.

Note that, the material of the releasing layer of the endless belt 83 is not particularly limited as long as the material has excellent heat resistance, durability, and releasing property with respect to the toner. Fluorocarbon resin is preferable. For example, PTFE or PFA may be independently used. Note that in the present embodiment, the internal diameter of the endless belt 83 is 30 mm (internal peripheral length is 94 mm) at room temperature (20° C.), but is not limited to this. Further, a width of the endless belt 83 (width of the support roller 81/82 in the rotation axis direction) is 320 mm at room temperature. However, a thermal expansion coefficient of polyimide is $5.6\times10^{-5}$/deg, so that temperature rise of 200° C. causes the endless belt 83 to thermally expand by about 3.6 mm (320 mm×$5.6\times10^{-5}$/deg×200° C. is substantially equal to 3.6) in the axis direction. Thus, the belt width at 220° C. which is a temperature set in carrying out a fixing operation of the endless belt 83 is 323.6 mm.

Each of the support rollers 81 and 82 is obtained by coating a surface of an aluminum metal core, whose external diameter is 15 mm and thickness is 2 mm, with a fluorine resin obtained by blending PTFE and PFA as a releasing layer and having the thickness of 20 μm. Note that, the material of the releasing layer is not particularly limited as long as the material has excellent heat resistance, durability, and releasing property with respect to the toner. For example, a fluorine material such as PFA, PTFE (polytetrafluoroethylene), and the like may be used. Further, the width of the support roller 81/82 in the axis direction (the width of a contact surface between the support roller 81/82 and the fixing roller 60 in the axis direction) is 320 mm at room temperature, and a center distance between the support rollers 81 and 82 is 23.0 mm.

Note that, a thermal expansion coefficient of aluminum is $2.4\times10^{-5}$/deg. Thus, in case where the support rollers 81 and 82 are heated to 220° C. (in case where temperature rise is 200° C.), the width of the support roller 81/82 thermally expands by 1.5 mm.

Further, the support rollers 81 and 82 are pressed against the peripheral surface of the fixing roller 60 via the endless belt 83 by a below-described belt release/contact operating device 110 with a predetermined load. As a result, the surface of the endless belt 83 comes into contact with the peripheral surface of the fixing roller 60, and a heating nip area is formed between the surface of the endless belt 83 and the peripheral surface of the fixing roller 60. Note that, the nip width (width along the peripheral direction of the fixing roller 60) between the surface of the endless belt 83 and the peripheral surface of the fixing roller 60 is 20 mm.

A thermistor 85*a* is in contact with an external surface of a contacting portion of the endless belt 83 which portion contacts the first support roller 81, and detects the surface temperature of the contacting portion of the endless belt 83. Further, a halogen lamp (heater lamp) 86*a* which generates heat by receiving power is provided in the first support roller 81. A thermistor 85*b* is in contact with an external surface of a contacting portion of the endless belt 83 which portion contacts the second support roller 82, and detects the surface temperature of the contacting portion of the endless belt 83. A halogen lamp (heater lamp) 86*b* which generates heat by receiving power is provided in the second support roller 82. Each of the halogen lamps 86*a* and 86*b* serves as a heat source of the endless belt 83. When power is supplied to the halogen lamps 86*a* and 86*b*, the halogen lamps 86*a* and 86*b* radiate heat so as to heat the endless belt 83 via the support rollers 81 and 82 to a predetermined temperature (220° C. in the present embodiment). The endless belt 83 is in contact with the peripheral surface of the fixing roller 60 from the outside of the fixing roller 60, so that it is possible to heat the peripheral surface of the fixing roller 60 via this contacting portion. In the present embodiment, the two support rollers 81 and 82 each of which is thin and has a small diameter and the endless belt 83 are used, so that it is possible to quickly raise temperature of the endless belt 83.

Figure 1:
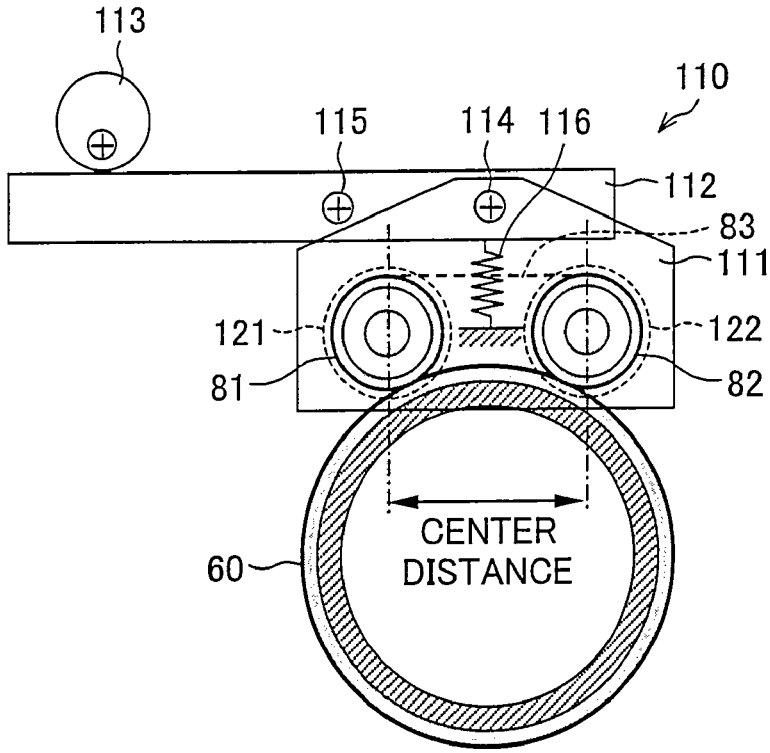
FIG. 1(*a*) and FIG. 1(*b*) are explanatory drawings each of which illustrates a fixing apparatus according to one embodiment of the present invention.
Figure 1:
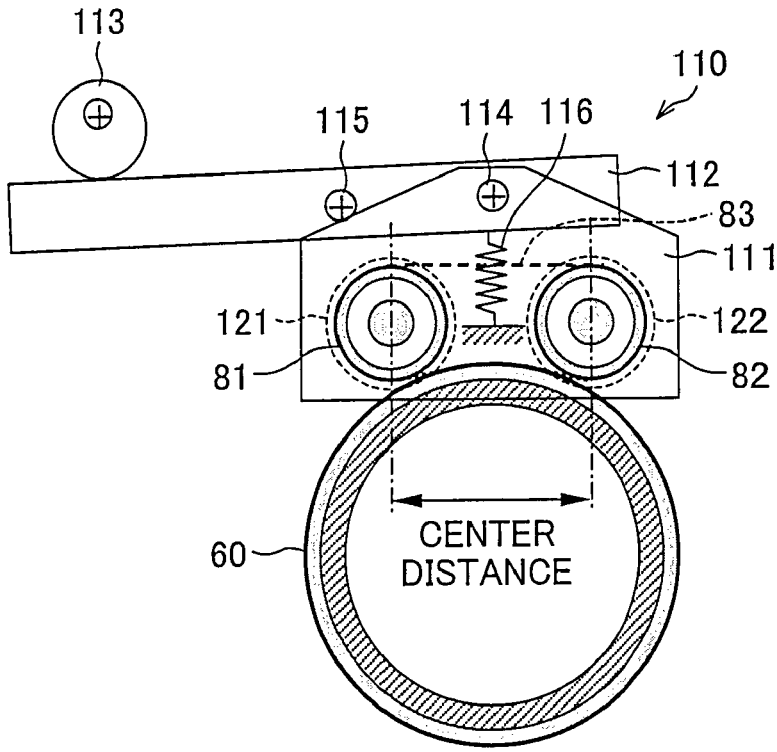
Figure 4:
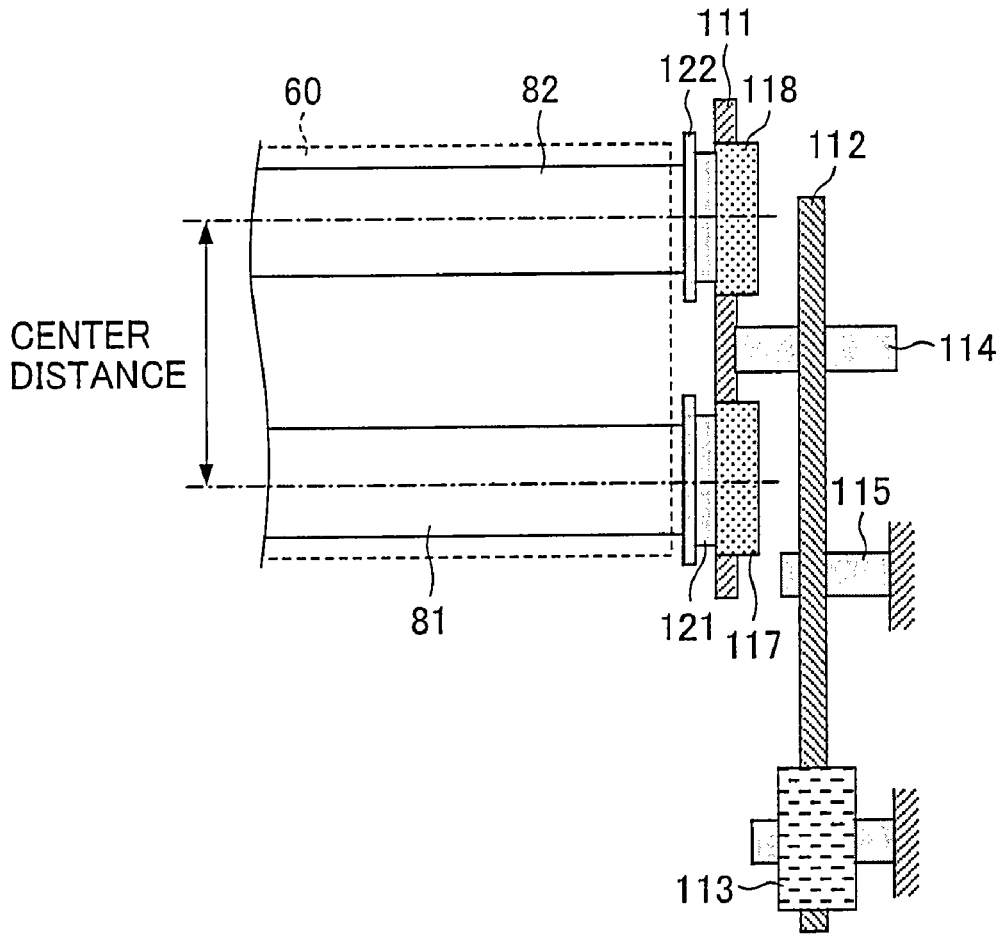
FIG. 4(*a*) is a top view illustrating an arrangement of a belt release/contact operating device provided on the fixing apparatus according to one embodiment of the present invention.
Figure 4:
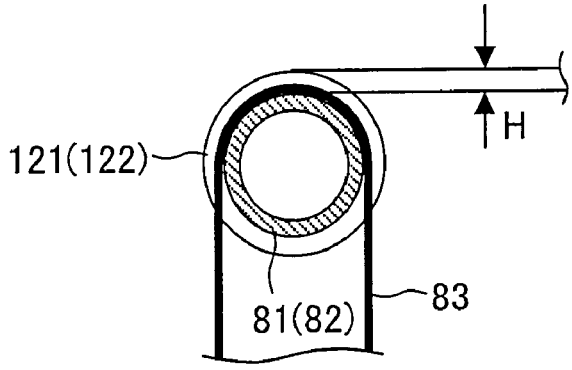

Next, the following will explain the belt release/contact operating device (release/contact operating means) 110 and the belt regulating members (regulating members) 121 and 122 which are provided in the fixing apparatus 40. FIG. 1(*a*) is a cross sectional view illustrating a state in which the belt release/contact operating device 110 carries the support rollers 81 and 82 to a position (first position) which allows the support rollers 81 and 82 to be in contact with the fixing roller 60 via the endless belt 83. FIG. 1(*b*) is a cross sectional view illustrating a state in which the belt release/contact operating device 110 carries the support rollers 81 and 82 to a position (second position) in which the support rollers 81 and 82 are separated from the fixing roller 60. Further, FIG. 4(*a*) is a top view illustrating an arrangement of the belt release/contact operating device 110. FIG. 4(*b*) is a cross sectional view illustrating arrangements of the support rollers 81 and 82, the endless belt 83, and the belt regulating members 121 and 122.

As illustrated in FIGS. 1(*a*), 1(*b*) and 4(*a*), the belt release/contact operating device 110 includes a side frame 111, an arm 112, an eccentric cam 113, a fulcrum (fulcrum member) 114, a fulcrum (fulcrum member) 115, and a coil spring 116. In FIG. 4(*a*), only one end of each of the support rollers 81 and 82 is shown, however the other end of each of the support rollers 81 and 82 has the same arrangement (that is an arrangement of the mirror image of the arrangement shown in FIG. 4(*a*)).

The side frame 111 is provided on each side of the support rollers 81 and 82 and holds the support rollers 81 and 82 rotatably via bearings 117 and 118 as illustrated in FIG. 4(*a*). Note that, the bearings 117 and 118 are fixed on the side frame 111 with a predetermined center distance therebetween. This allows the first and second support rollers 81 and 82 to be parallel to each other. In the present embodiment, a common difference between the first and second support rollers 81 and 82 in view of the parallelism is not more than 100 μm. Further, in the present embodiment, a distance between the bearings 117 and 117 which are provided on both ends of the first support roller 81 is 331 mm, and also a distance between the bearings 118 and 118 which are provided on both ends of the second support roller 82 is 331 mm.

The side frame 111 is supported by the fulcrum 114 of the arm 112 so as to be rotatable in a substantially perpendicular direction with respect to the axis direction of the support roller 81/82.

The arm 112 is rotatably supported by the fulcrum 115 fixed on a frame of the fixing apparatus 40 (not shown), and the arm 112 is pressed toward the fixing roller 60 by the coil spring 116 with the fulcrum 115 serving as an axis.

The eccentric cam 113 is provided so as to be in contact with a vicinity of an end portion of the arm 112. The control device 90 controls driving means such as a motor (not shown) and the like, so that the eccentric cam 113 is rotated.

As a result, the control device 90 (release/contact operating control section 90*c*) controls the driving means so as to rotate the eccentric cam 113, thereby moving the support rollers 81 and 82 to the first position as illustrated in FIG. 1(*a*) or the control device 90 further rotates the eccentric cam 113 at 180° C., thereby moving the support rollers 81 and 82 to the second position as illustrated in FIG. 1(*b*).

Note that in the present embodiment, a distance between the fulcrum 114 in the first position and the peripheral surface of the fixing roller 60 is 28 mm, and a distance between the fulcrum 114 in the second position and the peripheral surface of the fixing roller 60 is 29.5 mm. That is, in case of moving the support rollers 81 and 82 from the first position to the second position, a distance by which the fulcrum 114 is moved (separation length) is 1.5 mm. Further, a distance between the fulcrum 114 and the fulcrum 115 is 15 mm, and a distance between (i) a contact portion between the arm 112 and the eccentric cam 113 and (ii) the fulcrum 115 is 15 mm (thus, a lever ratio is 1:1). Thus, also a distance by which the contact portion between the arm 112 and the eccentric cam 113 is moved is 1.5 mm.

Further, in the present embodiment, a rotational direction contact width (heating nip width) of the endless belt 83 and the fixing roller 60 in stopping the rotation of the fixing roller 60 in the second position is about 10 mm. However, the contact width is a value which can be varied depending on a curving property and temperature of the endless belt 83. Generally, when the belt is heated, the peripheral length of the belt expands, so that the contact width increases. Note that, the separation length is 1.5 mm in the present embodiment, but in case where the separation length is set to be 4 mm, the endless belt 83 and the fixing roller 60 are completely separated from each other without being contact with each other by moving the endless belt 83 to the second position. Thus, in some cases, the endless belt 83 and the fixing roller 60 may be separated from each other at the second position.

Note that, as illustrated in FIG. 4(*a*) and FIG. 4(*b*), the belt regulating member (deviance regulating member, regulating member) 121 is provided between the support roller 81 and the bearing 117, and the belt regulating member 122 is provided between the support roller 82 and the bearing 118. The belt regulating members 121 and 122 prevent the snaking endless belt 83 from deviating in the axis direction of the support rollers 81 and 82 by rotating while being in contact with a side portion of the belt. At the same time, the regulating members 121 and 122 prevent the side portion of the endless belt 83 from being in friction with the bearings 117 and 118, thereby preventing abrasion or breakage of the endless belt 83.

The belt regulating members 121 and 122 are respectively rotatable around the support rollers 81 and 82 (the belt regulating members 121 and 122 can respectively rotate around rotational axes of the support rollers 81 and 82 independently from rotation of the support rollers 81 and 82), and the belt regulating members 121 and 122 are movable also in the axis direction of the support rollers 81 and 82 independently from the support rollers 81 and 82. Note that the belt regulating members 121 and 122 may be integrally fixed to the bearings 117 and 118, respectively. In this case, cracking occurs at the side portion of the endless belt 83 when the number of printed recording materials is smaller than that of the above arrangement. Therefore, it is more preferable that the belt regulating members 121 and 122 be respectively rotatable around the support rollers 81 and 82, and the belt regulating members 121 and 122 be movable also in the axis direction of the support rollers 81 and 82 independently from the support rollers 81 and 82. The belt regulating member 121 (122) may be configured to be either (i) rotatable around the support roller 81 (82), or (ii) movable in the axis direction of the support roller 81 (82) independently from the support roller 81 (82).

The belt regulating members 121 and 122 are made of phenol resin or PEEK resin. It is preferable that the material (s) of the belt regulating members 121 and 122 be different from the material used for the endless belt 83. When those materials are different from each other, it is possible to prevent fusion between the materials even when the belt regulating members 121 and 122 having high temperature contact the endless belt 83. Especially, it is preferable that the materials of the belt regulating members 121 and 122 which rotate be a heat-resistant material that is different from the material of the belt, and phenol resin or PEEK material is desirable.

Moreover, the material composition of the bearing 117 (118) is different from that of the belt regulating member 121 (122). For example, it is possible to use, as the material composition of the bearing 117 (118), heat-resistant resin in which lubricant is dispersed, such as polyimide resin, phenol resin, or PEEK resin. Since the material composition is different between the bearing 117 (118) and the belt regulating member 121 (122), it is possible to prevent fusion between the materials even when the belt regulating member 121 (122) having high temperature contact the bearing 117 (118).

Further, as illustrated in FIG. 4(*b*), a cross sectional shape of each of the belt regulating members 121 and 122 in the axis direction of each of the support rollers 81 and 82 is a concentric circle with respect to a circle of a cross section of each of the support rollers 81 and 82, and each belt regulating member is provided so that its height H (mm) from the peripheral surface (belt suspending surface) of each support roller is 2.5 mm in the present embodiment.

Further, each of the support rollers 81 and 82 has the thickness of 3 mm of the axis direction in a portion corresponding to each of the belt regulating members 121 and 122. Thus, as described above, the fixing roller 60 has the width of 320 mm in the axis direction, the endless belt 83 has the width of 320 in the axis direction at room temperature and has the width of 323.6 mm in the axis direction at 220° C., and the distance between the bearings 117 (118) is 331 mm, so that a width of a portion of the endless belt 83 which portion is not in contact with the peripheral surface (fixing surface) of the fixing roller 60 is up to 5 mm.

As illustrated in FIG. 3, the control device 90 includes a temperature control section (temperature control means) 90*a*, a rotation control section (rotation control means) 90*b*, and the release/contact operating control section (release/contact operating control means) 90*c*, and serves as a control integrated circuit substrate which controls surface temperature of the endless belt 83, surface temperature of the fixing roller 60, surface temperature of the pressing roller 70, rotation driving of the fixing roller 60, movement of a belt position which is carried out by the belt release/contact operating device 110.

The temperature control section 90*a* is connected to the thermistors 65, 75, 85*a*, 85*b*, and a heating power supply section 99. The heating power supply section 99 is connected to the halogen lamps 64, 74, 86*a*, and 86*b* so as to supply power to the halogen lamps so that the halogen lamps generate heat. Further, the temperature control section 90*a* switches power, supplied from the heating power supply section 99 to the halogen lamps, in accordance with temperature detection results of the thermistors 65, 75, 85*a*, and 85*b*, an image formation mode, and the like, so as to control heat of the halogen lamps, thereby controlling temperatures of the endless belt 83, the fixing roller 60, and the pressing roller 70 to be predetermined temperatures.

The rotation control section 90*b* is connected to the rotation driving device 91 for rotating the fixing roller 60. The rotation control section 90*b* controls a rotation speed of the fixing roller 60 by controlling operation of the rotation driving device 91.

Here, during a warm-up, the fixing roller 60 stops, and the temperature of the endless belt 83 increases. When the temperature of the endless belt 83 reaches 150° C. or more, the rotation control section 90*b* causes the fixing roller 60 to rotate, so that the endless belt 83 is driven at this point, that is, starts rotating at this point. When the temperature of the endless belt 83 is 150° C. or higher, the material of the endless belt 83 gets soft, and the bending deformation of the endless belt 83 is corrected. Therefore, the endless belt 83 can be rotated smoothly by the rotation of the fixing roller 60 without any trouble, such as cracking.

The release/contact operating control section 90*c* is connected to the belt release/contact operating device 110 and controls relative positions of the support rollers 81 and 82 and the fixing roller 60 that are provided in the external heating device 80 by controlling operation of the eccentric cam 113 provided on the belt release/contact operating device 110, so as to change the contact width (heating nip width) between the endless belt 83 and the fixing roller 60, thereby controlling heat supplied from the external heating device 80 to the fixing roller 60.

Further, the release/contact operating control section 90*c* causes the support rollers 81 and 82 to move between the first and second positions in accordance with a type of the sheet P (recording material) or an image formation mode (a case of a monochrome image formation mode or a case of a color image formation mode, or a case of feeding a single sheet or a case of sequentially feeding plural sheets), so as to change a contact area (heating nip width) of the endless belt 83, thereby controlling heat supplied from the external heating device 80 to the fixing roller 60.

In case of dropping the copying speed, the release/contact operating control section 90*c* moves the support rollers 81 and 82 from the first position to the second position. For example, in case where (i) a sheet transport speed in the monochrome mode is set to 355 mm/s and a sheet transport speed in the color mode is set to 175 mm/s, (ii) a fixing roller set temperature in the monochrome mode and a fixing roller set temperature in the color mode are 180° C., and (iii) the heating nip width between the endless belt 83 and the fixing roller 60 is 20 mm, when the temperature of the endless belt 83 is set to 220° C. in the monochrome mode and is set to 205° C. in the color mode, heat which shifts to the sheet P is substantially equal to heat supplied from the external heating device 80 to the fixing roller 60.

Thus, in case of changing the mode from the monochrome mode to the color mode, the temperature of the endless belt 83 is much higher than the set temperature. If a color image is fixed with excessively high temperature of the endless belt 83, the temperature of the fixing roller 60 becomes excessively high, so that the color image becomes excessively glossy or the gloss becomes uneven, which results in a low quality image. In order to avoid such problem, it may be so arranged that no operation is carried out until the temperature of the endless belt 83 drops to a predetermined temperature in shifting from the monochrome mode to the color mode. However, it takes 30 seconds or longer for the temperature of the endless belt 83 to drop from 220° C. to 205° C., so that it is impossible to smoothly shift from the monochrome mode to the color mode. As a result, waiting time occurs.

Thus, in the present embodiment, the release/contact operating control section 90*c* controls the relative positions of the support rollers 81 and 82 with respect to the fixing roller 60 (for example, the release/contact operating control section 90*c* mechanically moves the support rollers 81 and 82 from the first position to the second position) so as to reduce a contact area between the endless belt 83 and the fixing roller 60, thereby suppressing heat supply from the external heating device 80 to the fixing roller 60.

Further, in sequentially feeding sheets, the release/contact operating control section 90*c* increases the contact area between the endless belt 83 and the fixing roller 60 in order to increase heat supplied from the external heating device 80 to the fixing roller 60 so that heat shifted to the sheets is compensated for.

In order to unify peripheral direction temperature distribution of the fixing roller 60 right after starting the image formation operation, the fixing roller 60 is heated and rotated, but no sheet P passes through the fixing nip section, so that heat does not shift from the fixing roller 60 to the sheet P. When the support rollers 81 and 82 are in the first position under this condition, heat is excessively supplied from the endless belt 83 to the fixing roller 60, so that the temperature of the fixing roller 60 becomes higher than the set temperature. Thus, in order to prevent heat from being excessively supplied to the fixing roller 60, the release/contact operating control section 90*c* controls the belt release/contact operating device 110 so as to reduce the contact area between the endless belt 83 and the fixing roller 60, thereby changing heat supplied from the external heating device 80 to the fixing roller 60 in short time.

Further, at the time of standby upon finishing the image forming operation (in leaving the apparatus as it is), the release/contact operating control section 90*c* moves the support rollers 81 and 82 to the second position in order to prevent unevenness of temperature in a peripheral direction of the fixing roller 60. That is, the release/contact operating control section 90*c* moves the support rollers 81 and 82 to the second position after carrying out the image forming operation and moves the support rollers 81 and 82 to the first position according to a timing at which the sheet P right after staring the image forming operation reaches the fixing nip section.

Note that, the release/contact operating control section 90*c* may control the relative positions of the support rollers 81 and 82 with respect to the fixing roller 60 so that the support rollers 81 and 82 are disposed in any positions between the first position and the second position in accordance with temperatures of respective members, a type of the sheet P (transfer medium, recording sheet), the image formation mode, and the like.

Moreover, in the present embodiment, since the relative positions of the support rollers 81 and 82 are fixed, the parallelism between the support rollers 81 and 82 can be held constant in a high level. With this, even in the case of using the endless belt 83 including the above base material, it is possible to carry out fixing (with respect to a large number of recording materials) stably for a long time.

Figure 5:
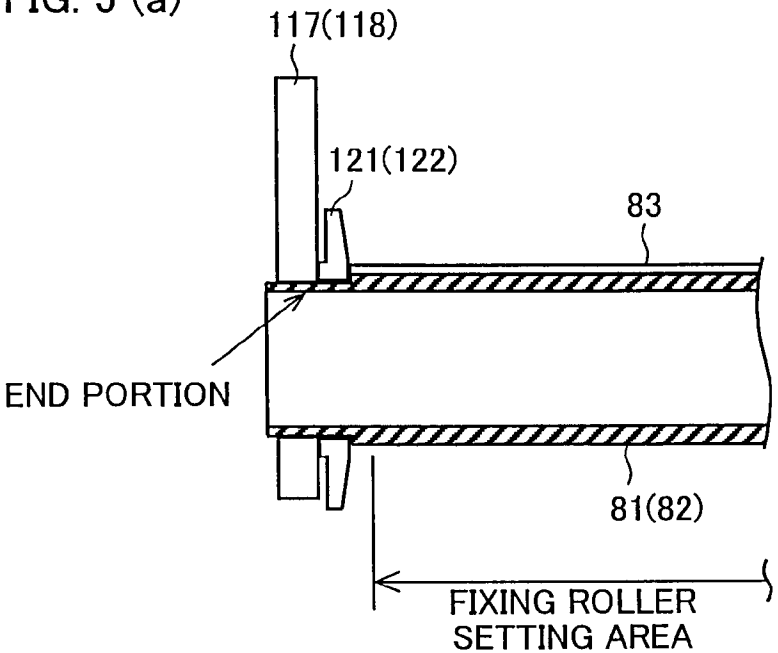
FIG. 5(*a*) is a cross-sectional view illustrating the vicinity of an end portion of the support roller of the fixing apparatus according to one embodiment of the present invention.
Figure 5:
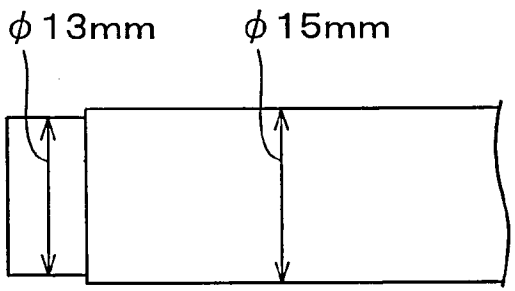
Figure 5:
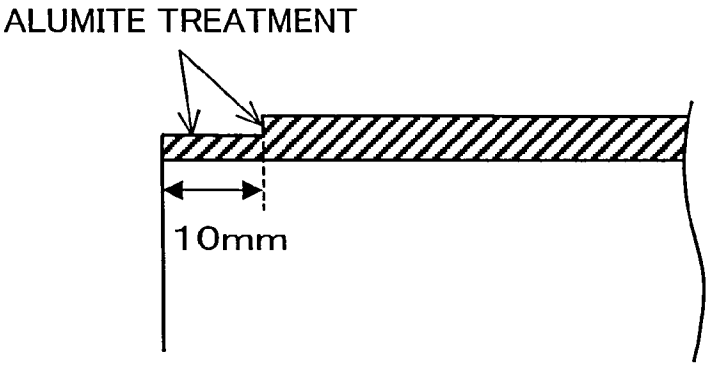
Figure 5:
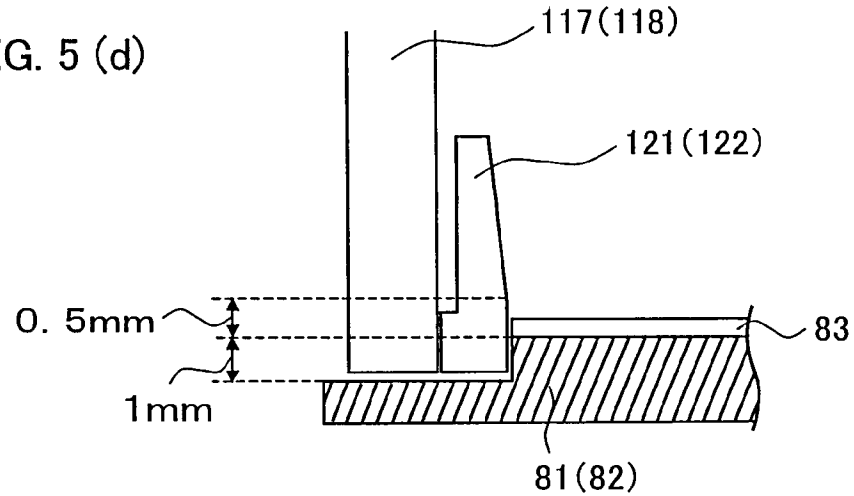

Moreover, in the present embodiment, the end portions of the support rollers 81 and 82 are subjected to an alumite treatment. As illustrated in FIG. 5(*a*), the end portions of the support rollers 81 and 82 have steps. For the purpose of specifically explaining this, FIG. 5(*b*) illustrates a diagram of only the support roller 81 (82), FIG. 5(*c*) illustrates an enlarged view of the end portion of the support roller 81 (82), and FIG. 5(*d*) illustrates an enlarged view of the vicinity of the end portion of the support roller 81 (82) and the position regulating member 121 (122). As illustrated in FIG. 5(*b*), the diameter of the end portion of the support roller 81 (82) is 13 mm, the end portion having a width of 10 mm in the axis direction, and the portion other than the end portion has a diameter of 15 mm. As illustrated in FIG. 5(*c*), the alumite treatment is carried out with respect to (i) the portion having the diameter of 13 mm and (ii) the surface of a step portion between the portion having the diameter of 13 mm and the portion having the diameter of 15 mm. Since the alumite treatment is carried out in this manner, it is possible to improve the abrasion resistance of a slide portion of the support roller 81 (82). Moreover, as illustrated in FIG. 5(*d*), a 1 mm portion plus a 0.5 mm portion of the position regulating member 121 (122) at the side portion of the endless belt 83 is perpendicular to the rotation axis of the support roller 81 (82), the 1 mm portion of the position regulating member 121 (122) corresponds to the step of the support roller 81 (82), and a further external peripheral side portion of the position regulating member 121 (122) inclines as illustrated in FIG. 5(*d*) and forms a tapered surface. When the support roller 81 (82) receives a thrust force in the axis direction and rotates while deviating toward one side, the support roller 81 (82) rotates while the alumite on the step surface of the support roller 81 (82) is contacting a surface of the position regulating member 121 (122), the surface being perpendicular to the rotation axis. Since the outside of the position regulating member 121 (122) is a tapered surface which inclines in a direction away from the endless belt 83, the side portion of the endless belt 83 suspended between the support rollers 81 and 82 does not rub even when the position regulating member 121 (122) rotates. Therefore, it is possible to prevent the deterioration of the side portion of the endless belt 83.

Here, the shape of the belt regulating member 121 (122) illustrated in FIG. 5(*a*) is different from that of the belt regulating member 121 (122) illustrated in FIG. 4(*a*), but the function of the belt regulating member 121 (122) illustrated in FIG. 5(*a*) is the same as that of the belt regulating member 121 (122) illustrated in FIG. 4(*a*). Moreover, the bearing 117 (118) illustrated in FIG. 5(*a*) in configured by integrally forming the bearing 117 (118) and the side frame 111 illustrated in FIG. 4.

Moreover, in the present embodiment, a relation among (i) an internal diameter d0 (30 mm in the present embodiment) of the endless belt 83, (ii) an external diameter d1 (15 mm in the present embodiment) of the support roller 81 (82) and (iii) an external diameter d2 (50 mm in the present embodiment) of the fixing roller 60 is represented by $\frac{1}{3}\times d2 \leqq d0 \leqq 3\times d1$. If this relation is realized, it is possible to adequately secure the life of the endless belt 83, and also possible to stably supply heat to the fixing roller 60 at the time of sequentially feeding sheets.

In the present embodiment, an angle formed between an external peripheral surface contacting the endless belt and the center of the support roller in a cross section of the support roller is the same between two support rollers 81 and 82. However, in a case where (i) there are a plurality of support rollers, (ii) the angle formed between the external peripheral surface contacting the endless belt and the center of the support roller in a cross section of the support roller is different between them, (iii) the external diameter of the support roller whose angle formed between the external peripheral surface contacting the endless belt and the center of the support roller in a cross section of the support roller is largest is set to d1, and (iv) the above relation formula is realized, it is possible to adequately secure the life of the endless belt.

Further, in the present embodiment, the two support rollers 81 and 82 are provided, and external diameters of the support rollers 81 and 82 are equal to each other, and the halogen lamps (heating elements) 86*a* and 86*b* are respectively provided in the support rollers 81 and 82. However, the present invention is not limited to this arrangement. The present invention is applicable to an external heating belt type fixing apparatus arranged in any manner. For example, three or more support rollers may be provided. Further, external diameters of the support rollers may be different from each other. Furthermore, a support roller having no heating element may be provided. The heating element may be provided in a position other than the inside of each support roller. Further, it may be so arranged that no support rollers (belt suspending rollers) are pressed against the fixing roller 60 at the time of the fixing operation and only the endless belt 83 is in contact with the fixing roller 60.

EXAMPLE 1

The durability of the belt in the fixing apparatus 40 explained in Embodiment 1 was measured.

In the present Example, as the base material of the endless belt 83 formed by stacking the releasing layer, having a thickness of 20 μm and made of PTFE and PFA, on the outermost surface of the base material having a thickness of 100 μm, used was a base material formed by dispersing 10 parts by weight of graphite in polyimide (Product Name: Upilex S, produced by UBE INDUSTRIES, LTD.) having a tensile strength of 500 MPa. Moreover, the belt regulating members 121 and 122 were rotatable in the same rotational direction as the endless belt 83, and movable in the axis direction of the support rollers 81 and 82 independently from the support rollers 81 and 82.

Since the sheets were sequentially output at an output rate of 70 sheets per minute (horizontal transport of A4 sheets) at a low-temperature environment (7° C.) with a basis weight of 105 g/m$^2$, the temperature of the fixing roller was controlled to 195° C. In this state, to continuously supply heat from the endless belt 83 to the fixing roller 60, the temperature of the endless belt 83 was controlled to 225° C. Thus, the measurement was carried out. Moreover, the measurement was carried out under such conditions that (i) the circumferential speed of the fixing roller 60 was set to 350 mm/s, and (ii) the contact force of the support rollers 81 and 82 contacting the fixing roller 60 (the length of a fixing portion is 320 mm) was set to 40 N (0.625 N per 1 cm of each support roller).

In the present Example, the endless belt 83 could withstand the output of 300,000 sheets. Since the strength of the base material of the endless belt 83 is high, the endless belt 83 could withstand the output of 300,000 sheets even though the position of the endless belt 83 was being regulated in the axis direction by the belt regulating members 121 and 122 contacting the side portions of the endless belt 83.

Moreover, in a case where the measurement was carried out under the same conditions as above using the fixing apparatus having the same arrangement as above except that the belt regulating members 121 and 122 were integrally fixed to the bearings 117 and 118, cracking occurred at the side portion(s) of the belt when 10,000 sheets were output.

In a case of, as Comparative Example, using the endless belt 83 whose base material was polyimide (Product Name: Kapton, produced by DuPont) having a tensile strength of 180 MPa (the other conditions are the same as above, and graphite was added), cracking occurred at the side portion(s) of the belt when 5,000 sheets were output. Thus, the adequate durability of the belt could not be obtained.

Embodiment 2

Another embodiment of the present invention is described as follows. Note that, for convenience in description, the same reference numerals as Embodiment 1 are given to members having the same functions as those of the members described in Embodiment 1, and descriptions thereof are omitted.

The present embodiment is different from Embodiment 1 in that there is not provided an external heating device 80 for heating the peripheral surface of the fixing roller 60 and there is provided an external heating device for heating the peripheral surface of the pressing roller 70. That is, the fixing apparatus according to the present embodiment includes the external heating device for coming into contact with the peripheral surface of the pressing roller 70, which is in contact with the rear surface (surface having no unfixed image thereon) of the sheet P, at the fixing nip section, so as to heat the peripheral surface of the pressing roller 70.

Figure 6:
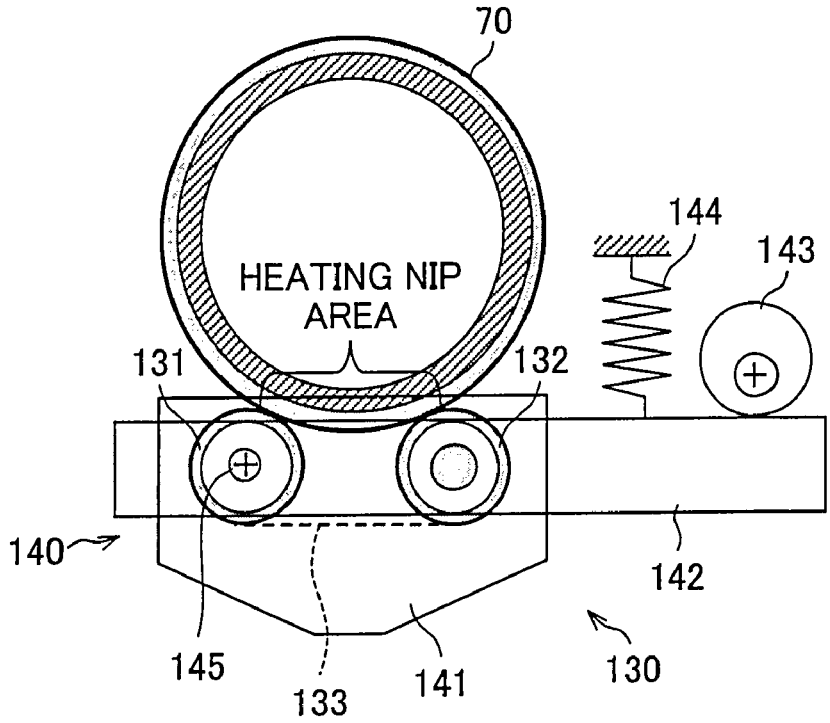
FIG. 6(*a*) and FIG. 6(*b*) are explanatory drawings each of which illustrates an arrangement of a fixing apparatus according to another embodiment of the present invention.
Figure 6:
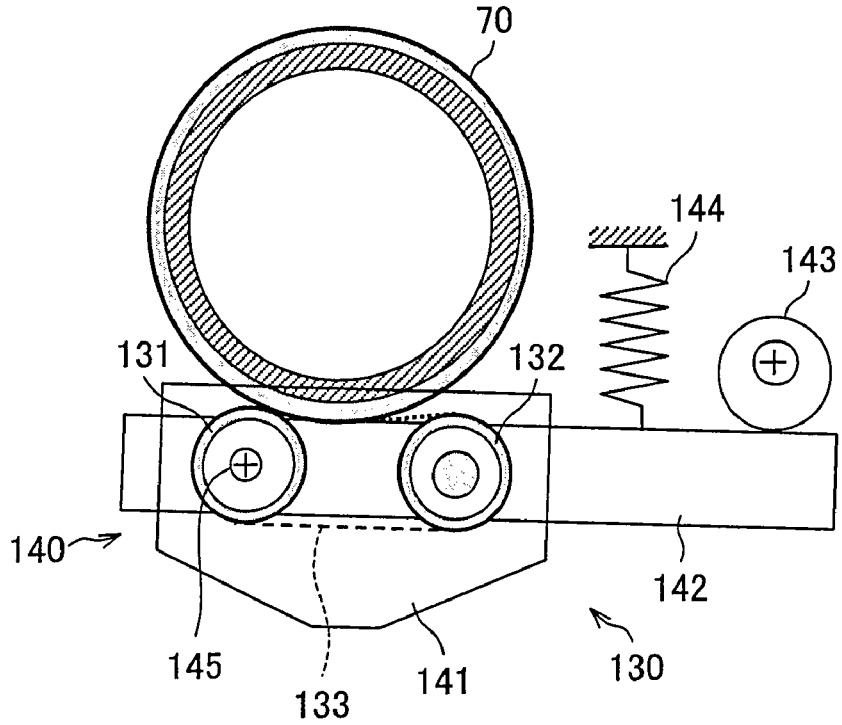

Each of FIGS. 6(*a*) and 6(*b*) illustrates an arrangement of the pressing roller 70 and the external heating device 130 for heating the peripheral surface of the pressing roller 70. Note that, FIG. 6(*a*) illustrates a case where a second support roller 132 provided on the external heating device 130 is in a below-described first position. FIG. 6(*b*) illustrates a case where the second support roller 132 is in a below-described second position.

As illustrated in FIGS. 6(*a*) and 6(*b*), the external heating device 130 includes a first support roller 131, the second support roller (heating roller) 132, an endless belt (belt) 133, and a belt release/contact operating device (release/contact operating means) 140. Note that in the following explanation, the first support roller 131 and the second support roller 132 are simply referred to as the support roller 131/132 when it is not necessary to distinguish the first support roller 131 and the second support roller 132.

The endless belt 133 is suspended by the support rollers 131 and 132 so that a rear side of the endless belt 133 is in contact with peripheral surfaces of the support rollers 131 and 132. The endless belt 133 is provided on the upstream side of the fixing nip section in a rotational direction of the pressing roller 70. When the second support roller 132 is in the below-described first position, the second support roller 132 is pressed against the pressing roller 70 with a predetermined pressure (40 N in the present embodiment). As a result, a heating nip area (a contact portion between the endless belt 133 and the pressing roller 70) is formed between the endless belt 133 and the pressing roller 70. In the present embodiment, a nip width of the heating nip area (a width along a peripheral direction of the pressing roller 70) is 20 mm.

Further, the endless belt 133 comes into contact with the peripheral surface of the pressing roller 70 which is rotating, so that the endless belt 133 is rotated by the pressing roller 70. As a result, the support rollers 131 and 132 rotate in a direction (K direction in FIG. 3) opposite to the rotational direction of the pressing roller 70. That is, when the control device 90 controls the rotation driving device 91 of the fixing roller 60 so as to rotate the fixing roller 60, the pressing roller 70 is rotated by the fixing roller 60, and a frictional force of a portion at which the endless belt 133 and the pressing roller 70 are in contact with each other causes the endless belt 133 to be rotated and moved by the pressing roller 70, so that the support rollers 131 and 132 and the endless belt 133 rotate.

The endless belt 133 and the support rollers 131 and 132 are arranged in the same manner as the endless belt 83 and the support rollers 81 and 82 which are provided on the external heating device 80 of Embodiment 1. However, no halogen lamp is provided in the first support roller 131, and a halogen lamp is provided in the second support roller 132. Note that, temperature detecting means (not shown) is provided on an external peripheral surface of the endless belt 133 so as to be positioned in the contact portion with respect to the second support roller 132, and the control device 90 controls (i) power supplied to the halogen lamp provided in the second support roller 132, (ii) a position to which the support rollers 131 and 132 are moved by the belt release/contact operating device 140, (iii) and the like, in accordance with a detection result of the temperature detecting means.

The belt release/contact operating device 140 presses the support rollers 131 and 132 against the peripheral surface of the pressing roller 70 via the endless belt 133 with a predetermined load. As a result, the surface of the endless belt 133 comes into contact with the peripheral surface of the pressing roller 70, so that a nip section (heating nip area) is formed between the surface of the endless belt 133 and the peripheral surface of the pressing roller 70.

The belt release/contact operating device 140 includes a side frame 141, an arm 142, an eccentric cam 143, a coil spring 144, and a fulcrum (fulcrum member) 145.

The side frame 141 is provided on each end of the support rollers 131 and 132 and rotatably supports the support rollers 131 and 132 via bearings (not shown). Note that, as in the bearings 117 and 118 provided on the external heating device 80 of Embodiment 1, a center distance between the bearings may be fixed or may be variable.

Further, the side frame 141 is fixed on the arm 142. The arm 142 is supported by a frame (not shown) of the fixing apparatus of the present embodiment via the fulcrum 145 so as to be rotatable in a direction substantially perpendicular to an axis direction of the support rollers 131 and 132. Note that, the fulcrum 145 is provided in a position corresponding to a rotational axis of the first support roller 131. Thus, even when the arm 142 is rotated around the fulcrum 145, the position of the first support roller 131 (the center distance between the first support roller 131 and the pressing roller 70) does not change. The center distance between the first support roller 131 and the pressing roller 70 is set so that both the rollers are pressed against each other via the endless belt 133 with a predetermined pressure. Further, the coil spring 144 is provided on the arm 142 so as to be positioned opposite to the fulcrum 145 with the second support roller 132 intervening therebetween, and the coil spring 144 pushes the side frame 141 provided on the arm 142 toward the pressing roller 70.

The eccentric cam 143 is provided so as to be in contact with a vicinity of an end portion of the arm 142. The control device 90 controls driving means (not shown) such as a motor and the like so as to rotate the eccentric cam 143. As a result, the control device 90 controls the driving means so as to rotate the eccentric cam 143, so that the support roller 132 is pressed against the pressing roller 70 by moving the second support roller 132 to the first position as illustrated in FIG. 6(*a*), or the eccentric cam 143 is further rotated by 180° C. and the second support roller 132 is moved to the second position as illustrated in FIG. 6(*b*) so as to separate the second support roller 132 from the pressing roller 70. Note that, the first support roller 131 is pressed against the pressing roller 70 also in the second position.

Note that, as in the belt regulating members 121 and 122 provided on the external heating device 80 of Embodiment 1, a belt regulating member (not shown) is provided between the support roller 131 and the bearing provided on each side of the support roller 131, and a belt regulating member (not shown) is provided between the support roller 132 and the bearing provided on each side of the support roller 132. That is, the belt regulating members each having height which extends from the peripheral surface of each of the support rollers 131 and 132 and which is longer than a distance between each of the support rollers 131 and 132 and the pressing roller 70 in the second position are provided on the support rollers 131 and 132 respectively so as to be positioned on their each side in the axis direction of the support rollers 131 and 132.

As described above, in the present embodiment, out of the two support rollers 131 and 132, the halogen lamp is provided only in the second support roller 132, and the belt release/contact operating device 140 allows the second support roller 132 having the halogen lamp therein to be in contact with the pressing roller 70 via the endless belt 133 or to be separated from the pressing roller 70.

Thus, the release/contact operating control section 90*c* provided in the control device 90 changes the position of the second support roller 132 (position relative to the pressing roller 70), thereby controlling heat supplied to the pressing roller 70. For example, by disposing the second support roller 132 in the second position, it is possible to promptly drop the surface temperature of the pressing roller 70, and it is possible to reduce surface temperature unevenness of the pressing roller 70.

Note that, in case of sequentially printing images on a small number of sheets P such as 1 to 5 sheets for example, the release/contact operating control section 90*c* may set the second support roller 132 to the second position. As a result, it is possible to prevent excessive temperature rise of the pressing roller 70, thereby preventing disadvantage such as lower quality of images.

That is, in case of printing images on a small number of sheets P, a ratio of time taken for the sheet P to actually pass through the fixing nip is small in a period from the beginning of the image formation operation to the completion of the sheet delivery. Thus, the temperature of the pressing roller 70 which is pressed against the fixing roller 60 having high temperature so as to rotate is likely to rise. If a wide area of the external heating device 130 is in contact with the pressing roller 70 (the first support roller 131 is set to be in the first position) under this condition, the temperature of the pressing roller 70 rises so as to be higher than the temperature set in the fixing operation (the temperature rises to about 160° C. for example). If such excessive temperature rise occurs, the image is excessively glossy, which results in minute hot offset or lower quality image. Particularly, in case of both-side printing in which a toner image is formed on a first surface of the sheet P and then a second image is formed on a second surface of the sheet P, the first surface on which the toner image has first formed is in contact with the pressing roller 70 in fixing the image on the second surface. At this time, if the temperature of the pressing roller 70 is excessively high, the image on the first surface is excessively glossy and glaring, which results in lower quality image.

Thus, the release/contact operating control section 90*c* causes the second support roller 132 to be in the first position in sequentially feeding six or more sheets for example so as to increase the contact area between the endless belt 83 and the pressing roller 70 and causes the second support roller 132 to be in the second position in forming images on five or less sheets so as to prevent excessive temperature rise of the pressing roller 70, thereby preventing the quality of the image from dropping.

Further, the release/contact operating control section 90*c* may move the second support roller 132 to the second position in carrying out the both-side printing. In fixing the image on the second surface at the time of the both-side printing, the fixing operation carried out with respect to the first surface causes the temperature of the sheet P to be high. Thus, in the fixing operation carried out with respect to the second surface, heat less shifts from the pressing roller 70 to the sheet P than in the fixing operation carried out with respect to the first surface. Thus, by moving the second support roller 132 to the second position at the time of the both-side printing, it is possible to decrease the contact area between the endless belt 133 and the pressing roller 70, thereby preventing excessive temperature rise of the pressing roller 70.

Further, only the support roller 132 out of the two support rollers 131 and 132 is separated, so that it is possible to decrease a distance by which the arm 142 moves, thereby reducing a size of the fixing apparatus and reducing power consumption of the belt release/contact operating device (detaching mechanism) 140.

Further, the first support roller 131 is always pressed against the pressing roller 70 with a predetermined pressure, so that the endless belt 133 is rotated by the pressing roller 70 without fail regardless of the position of the arm 142.

Further, the first support roller 131 is always pressed against the pressing roller 70 regardless of the position of the arm 142, so that it is possible to prevent the belt regulating member provided on each side of the first support roller 131 from moving to a position where the regulating member is in contact with the peripheral surface of the pressing roller 70 even when the second support roller 132 is moved to the second position.

Note that, it is not necessary to provide the belt regulating members so as to respectively correspond to both the support rollers 131 and 132. However, in case of providing the belt regulating member on each side of the second support roller 132, it is preferable that the belt regulating member has height from the surface of the second support roller 132 which height is longer than the distance between the pressing roller 70 and the second support roller 132 in the second position. As a result, it is possible to surely prevent the belt regulating member from moving to the position where the belt regulating member is in contact with the peripheral surface of the pressing roller 70.

Further, in the respective embodiments, the external heating device is provided either the fixing roller 60 (at the fixing nip section, the roller is in contact with the surface of the sheet P which surface has an unfixed toner image thereon) or the pressing roller 70 (at the fixing nip section, the roller is in contact with the surface of the sheet P which surface has no unfixed toner image thereon). However, external heating devices may be respectively provided on the fixing roller 60 and the pressing roller 70. In case of providing the external heating devices on the fixing roller 60 and the pressing roller 70 respectively, it is possible to highly accurately control the surface temperatures of both the fixing roller 60 and the pressing roller 70 at the time of sequential sheet feeding and at the time of standby. As a result, it is possible to stably obtain a high quality image and it is possible to continuously obtain high throughput.

Further, the external heating device 130 of Embodiment 2 may be used instead of the external heating device 80 of Embodiment 1, or the external heating device 80 of Embodiment 1 may be used instead of the external heating device 130 of Embodiment 2.

Further, in the present embodiment, the image forming apparatus is arranged so as to transport sheets by using the transport belt, but the image forming apparatus is not limited to this arrangement. The present invention is applicable to an electrophotographic image forming apparatus. For example, the image forming apparatus may be arranged so that an intermediate transfer belt is used or may be arranged so that an image is transferred from the photoreceptor to the sheet P. Further, the image forming apparatus may form a monochrome image or may form a multicolor image.

Further, in the respective embodiments, the control device 90 includes a control integrated circuit substrate, but the control device 90 is not limited to this arrangement. It may be so arranged that a processor such as a CPU and the like is used to realize functions of the control sections of the control device 90 by software. In this case, for example, the control device 90 includes: a CPU (central processing unit) for carrying out a command of a control program for realizing the functions; a ROM (read only memory) in which the program is stored; a RAM (random access memory) for developing the program; a storage device (storage medium), such as a memory, in which the program and various kinds of data are stored; and the like. Further, the object of the present invention can be achieved as follows: a storage medium for computer-readably storing a program code (an execute form program, intermediate code program, or source program) of the control program of the control device 90 which control program is software for implementing the aforementioned functions is provided to the control device 90, and a computer (or CPU and MPU) provided on the control device 90 reads out the program code stored in the storage medium so as to implement the program, thereby achieving the object of the present invention.

Examples of the storage medium which satisfies these conditions include: tapes, such as magnetic tape and cassette tape; disks including magnetic disks, such as floppy disks (registered trademark) and hard disk, and optical disks, such as CD-ROMs, magnetic optical disks (MOs), mini disks (MDs), digital video disks (DVDs), and CD-Rs; cards, such as IC card (including memory cards) and optical cards; and semiconductor memories, such as mask ROMs, EPROMs, EEPROMs, and flash ROMs.

Further, it may be so arranged that: the control device 90 is made connectable to communication networks, and the program code is supplied via the communication networks. The communication networks are not limited to a specific means. Specific examples of the communication network include Internet, intranet, extranet, LAN, ISDN, VAN, a CATV communication network, a virtual private network, a telephone line network, a mobile communication network, a satellite communication network, and the like. Further, a transmission medium constituting the communication network is not particularly limited. Specifically, it is possible to use a wired line such as a line in compliance with IEEE1394 standard, a USB line, a power line, a cable TV line, a telephone line, an ADSL line, and the like, as the transmission medium. Further, it is possible to use (i) a wireless line utilizing an infrared ray used in IrDA and a remote controller, (ii) a wireless line which is in compliance with Bluetooth standard (registered trademark) or IEEE802.11 wireless standard, and (iii) a wireless line utilizing HDR, a mobile phone network, a satellite line, a ground wave digital network, and the like, as the transmission medium. Note that, the present invention can be realized by a computer data signal (data signal sequence) which is realized by electronic transmission of the program code and which is embedded in a carrier wave.

Further, in the foregoing embodiments, each of the fixing member (fixing roller) and the pressing member (pressing roller) has a roller shape, but the shape thereof is not limited to this. For example, each of the fixing member and the pressing member may have a belt shape.

As above, a fixing apparatus of the present invention includes: a fixing member and a pressing member, at least one of which is a heated member; and an external heating device which (i) heats a belt rotatably suspended by a plurality of support rollers, at least one of which includes therein a heat source and (ii) causes the belt to contact a peripheral surface of at least one of the fixing member and the pressing member to heat the heated member, the fixing member and the pressing member sandwiching and transporting a recording material so that an unfixed image on the recording material is fixed on the recording material, the fixing apparatus further including a regulating member which (i) is provided outside, in an axis direction of the support roller, a facing portion of the support roller which portion faces the heated member, and (ii) contacts a side portion of the belt to regulate the position of the belt in the axis direction, the belt including a base material made of polyimide having a tensile strength of 300 MPa or more and a thickness of 50 μm to 200 μm, and a releasing layer on a surface of the base material, and in the base material, 5 to 25 parts by weight of graphite being dispersed in 100 parts by weight of polyimide.

Moreover, in addition to the above arrangement, in the fixing apparatus of the present invention, the regulating member may be either rotatable in a rotational direction of the belt or movable in the axis direction of the support roller independently from the support roller.

In a case where the regulating member is not rotatable, the side portion of the belt locally abrade the regulating member, so that a groove corresponding to the thickness of the side portion of the belt is formed on the regulating member. Then, since the belt rotates while getting into this groove, the belt receives excessive stress, and the durability of the belt decreases. In contrast, as in the above arrangement, when the regulating member is rotatable along the rotational direction of the belt, it is possible to prevent the belt from continuously rubbing only one portion of the regulating member. Therefore, it is possible to prevent the formation of the above groove, and also possible to prevent the decrease in the durability of the belt.

Moreover, when the regulating member is not movable in the axis direction of the support roller, the position of the regulating member in the axis direction changes due to deviance of the support roller in the axis direction or the thermal expansion of the support roller. In contrast, as in the above arrangement, when the regulating member is movable in the axis direction of each support roller independently from the support roller, it is possible to regulate the position of the belt in the axis direction regardless of the deviance and thermal expansion of the support roller, and also possible to accurately determine the relative positions of the heated member and the belt.

Moreover, in addition to the above arrangement, the fixing apparatus of the present invention may include temperature control means for controlling the temperature of the belt during operation so that the maximum temperature of the belt when it is stopped is lower than the melting point of the releasing layer, and the heated member is heated to a minimum required temperature for the fixing operation.

If the temperature of the stopped belt exceeds the melting point of the releasing layer, the heat deterioration occurs on the surfaces of the belt and heated member. In such a case, the smooth rotation of the belt and the heat conduction to the fixing roller deteriorate, and the uneven fixation occurs on the fixed image. In contrast, according to the above arrangement, the temperature of the stopped belt does not exceed the melting point of the releasing layer. Therefore, the heat deterioration does not occur on the surface of the belt or heated member, the above problems are avoidable, and the heated member can be heated to a minimum required temperature for the fixing operation.

Moreover, in addition to the above arrangement, it is preferable that the fixing apparatus of the present invention further include: temperature detecting means for detecting temperature of the belt; and temperature control means for controlling the temperature of the belt on the basis of a detection of the temperature detecting means, the releasing layer of the belt include fluorocarbon resin, and when a developer whose melting point is from 100° C. to 140° C. is used to develop the unfixed image, the temperature control means operate so that the temperature of the belt during a rotation operation becomes 30° C. or more lower than a melting point of the fluorocarbon resin and also becomes 20° C. or more higher than a set temperature of the heated member.

When the fixing apparatus is stopped suddenly during continuous operation, the surface temperature of the belt may increase by 30° C. or more and exceed the melting point of the surface of the belt. Moreover, when the temperature of the belt during operation is set to be 20° C. lower than the temperature of the heated member, the temperature of the heated member decreases at the time of sequentially feeding sheets, and this causes fixation failure. Moreover, if the melting point of the toner is lower than 100° C., the flowability of the toner decreases due to the stress in a developing device or the increase in the temperature inside the developing device, and the flowability and delivery necessary at the time of development cannot be obtained. Moreover, if the melting point of the toner exceeds 140° C., the temperature of the belt exceeds the melting point of fluorocarbon resin. Therefore, it is impossible to realize an external heating arrangement using, as the releasing layer, fluorocarbon resin having excellent releasing property. However, according to the above arrangement, it is possible to heat the heated member while avoiding all the above problems.

Moreover, in addition to the above arrangement, the fixing apparatus of the present invention may further include release/contact operating means for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position, and relative positions of the plurality of support rollers may be fixed.

In the case of adjusting the belt by using (i) a tension roller, to both ends of which a certain spring force is applied and (ii) a fixed axis, the tension roller inclines with respect to the fixed axis due to the difference between left and right circumferences of the belt. This inclination causes excessive deviation force which causes the belt to move in the axis direction of the support roller, and the stress at the side portion of the belt which portion contacts the regulating member become excessive. Therefore, the life of the belt becomes short. Especially, when the support roller is movable with respect to the heated member, the tension roller moves much depending on a state of contact between the belt and the heated member. At the time of this movement, the parallelism between the fixed axis and the tension roller changes due to not only the difference between circumferences of the belt but also the nonuniformity or changes of the parallelism between the support roller and the heated member and the contact force between the heated member and the support roller.

In contrast, according to the above arrangement, since the relative positions of a plurality of support rollers are fixed, the parallelism among the support rollers can be held constant in a high level. With this, even in the case of using the belt including the above base material, it is possible to carry out fixing (with respect to a large number of recording materials) stably for a long time. Note that "a second position which allows the belt to be in contact with the heated member so that the contact area is smaller than in the first position" may be a position which allows the belt not to be in contact with the heated member (there is no contact area).

Moreover, in addition to the above arrangement, the fixing apparatus of the present invention may further include rotation control means for controlling a rotation of the heated member, and the belt may be rotated by the rotation of the heated member.

If the heated member and the belt rub each other, the releasing layer on the surface of the belt abrades away, and the durability of the belt decreases. However, according to the above arrangement, since the belt is rotated by the rotation of the heated member, it is possible to minimize rubbing against the surface of the heated member. Moreover, since driving means for driving the belt is unnecessary, it is possible to realize a simple, inexpensive apparatus.

When the rotation control means causes the rotation of the heated member to stop when having detected malfunction (when the recording material has gotten stuck), it is possible to prevent the stuck recording material from winding around the heated member or to prevent the occurrence of such a state that it is difficult to remove the recording material. Moreover, when the rotation control means causes the rotation of the heated member to stop when detecting malfunction (for example, when a door of an apparatus main body is left open), it is possible to prevent an operator from being pinched between the rotating fixing member and pressing member.

By using the belt arranged as above, the belt can be rotated by the rotation of the heated member without slipping on the support rollers.

Moreover, in addition to the above arrangement, in the fixing apparatus of the present invention, a contact force of the support roller contacting the heated member via the belt may be from 0.25 N to 5 N per 1 cm of each support roller.

If the contact force of the support roller contacting the heated member via the belt is less than 0.25 N per 1 cm of each support roller, the belt slips on the heated member at the start of rotation so as not to rotate. Therefore, heat cannot be adequately supplied to the heated member, and the temperature of the heated member decreases at the time of sequentially feeding sheets. Thus, fixation failure occurs on the recorded image. Meanwhile, if the contact force of the support roller contacting the heated member via the belt exceeds 5 N per 1 cm of each support roller, the support roller bends, and the contact between the center portion of the belt and the heated member becomes weaker than the contact between the side portion of the belt and the heated member. Therefore, heat supply from the center portion of the belt decreases, and the fixing at the center portion of the image becomes insufficient at the time of sequentially feeding sheets. Moreover, the contact force between the bearing at the end portion of the support roller and the support roller increases, the bearing abrades away significantly, and the durability of the bearing decreases.

In contrast, according to the above arrangement, since the contact force of the support roller contacting the heated member via the belt is from 0.25 N to 5 N per 1 cm of each support roller, the support roller can satisfactorily contact the heated member via the belt.

Moreover, in addition to the above arrangement, in the fixing apparatus of the present invention, it is preferable that a relation among (i) an internal diameter d0 of the belt, (ii) an external diameter d1 of the support roller whose angle formed between an external peripheral surface contacting the belt and a center of the support roller in a cross section of the support roller is largest among the support rollers, and (iii) an external diameter d2 of the heated member be represented by $\frac{1}{3} \times d2 \leqq d0 \leqq 3 \times d1$.

If the support roller whose angle formed between the external peripheral surface contacting the belt and the center of the support roller in a cross section of the support roller is largest is too small in diameter, and the high-temperature belt is left as it is in such a state that the belt winds around the rollers, the bending deformation of the belt occurs significantly. Thus, in the next operation of the belt, the belt does not rotate even if the heated member rotates. Moreover, if the support roller whose angle formed between the external peripheral surface contacting the belt and the center of the support roller in a cross section of the support roller is largest is small in diameter, the tension of the external peripheral surface of the belt winding around the rollers and the compression of the inner peripheral surface become significant, the belt fatigues by long periods of rotation, and the life of the belt cannot be adequately secured. A preferable diameter of the support roller whose angle formed between the external peripheral surface contacting the belt and the center of the support roller in a cross section of the support roller is largest relates to the diameter of the belt in a free state. The belt whose diameter in a free state is small does not have problems regarding the rotation state and the durability even in the case of using thin support rollers, but the above problems occur in the case of using the belt whose diameter in a free state is large and the thin support rollers. When the diameter of the support roller whose angle formed between the external peripheral surface contacting the belt and the center of the support roller in a cross section of the support roller is largest is ⅓ or more the internal diameter of the belt, it is possible to secure satisfactory rotation state and life of the belt.

Further, if the support roller whose angle formed between the external peripheral surface contacting the belt and the center of the support roller in a cross section of the support roller is largest is small in diameter, the support roller bends, and the contact between the center portion of the belt and the heated member becomes weaker than the contact between the side portion of the belt and the heated member. Therefore, heat supply from the center portion of the belt decreases, and the fixing at the center portion of the image becomes insufficient at the time of sequentially feeding sheets.

Meanwhile, if the heated member is small in diameter, the belt bends, at the heating nip between the belt and the heated member, in a direction opposite a direction in which the belt normally bends. Since a portion of the belt which portion winds around the support roller bends in the direction in which the belt normally bends, it is possible to secure the life of the belt even if the support roller is small in diameter. However, since a portion of the belt which portion contacts the heated member bends in the direction opposite the direction in which the belt normally bends, a compressed portion and a tensed portion are inverted. Therefore, in the case of long periods of rotation, the material fatigues by repeated stress. However, it is possible to adequately secure the life of the belt if the diameter of the support roller whose angle formed between the external peripheral surface contacting the belt and the center of the support roller in a cross section of the support roller is largest is 3 times or less the diameter of the heated member.

Moreover, in addition to the above arrangement, in the fixing apparatus of the present invention, it is preferable that the belt start being rotated when the temperature of the belt is 150° C. or more.

If the high-temperature belt is left as it is in such a state that the belt winds around the support roller whose curvature is small, and is cooled down to room temperature, the bending deformation of the belt occurs, and the belt does not easily rotate only by the friction with the fixing roller. In the above arrangement, the belt starts being rotated when the temperature of the belt reaches 150° C. or more. When the temperature of the belt is 150° C. or more, the material of the belt gets soft, and the bending deformation of the belt is corrected. Therefore, the belt can be rotated by the rotation of the heated member.

In the case of a conventional belt made of a polyimide material, since the stiffness of the material is low, the bending deformation is not so significant. Therefore, the belt can be rotated by the rotation of the heated member even at less than 150° C.

Moreover, in addition to the above arrangement, in the fixing apparatus of the present invention, a material composition of the regulating member may be different from a material composition of the belt.

In the case of forming the regulating member using the same material as the belt, the regulating member fuses to the material of the belt, cracking occurs at the side portion of the belt at high temperature, and the life of the belt cannot be adequately obtained. However, according to the above arrangement, since the material of the regulating member is different from the material used for the belt, it is possible to prevent these materials from fusing to each other even if the regulating member contacts the belt at high temperature.

Especially, it is preferable that the material of the regulating member which rotates be a heat-resistant material that is different from the material of the belt, and phenol resin or PEEK material is desirable.

Moreover, in addition to the above arrangement, in the fixing apparatus of the present invention, a material composition of a bearing of each of the support rollers may be different from a material composition of the regulating member.

In the case of forming the bearing of the support roller using the same material as the regulating member, the bearing fuses to the regulating member, and disturbs the rotation of the regulating member at high temperature. Thus, high stress is applied to the side portion of the belt contacting the stopped regulating member, cracking occurs at the side portion of the belt, and the life of the belt cannot be adequately obtained. However, according to the above arrangement, since the material composition of the bearing of each of the support rollers is different from the material composition of the regulating member, it is possible to prevent these materials from fusing to each other even if the regulating member contacts the bearing at high temperature. Therefore, it is possible to further extend the life of the belt.

As the material of the bearing of the support roller, it is possible to use, for example, a heat-resistant resin in which lubricant is dispersed, such as polyimide resin, phenol resin or PEEK resin.

An image forming apparatus of the present invention includes any one of the above fixing apparatuses. Again, effects substantially similar to the effects of the above fixing apparatus can be obtained.

The present invention is not limited to the description of the embodiments above, but may be altered by a skilled person within the scope of the claims. An embodiment based on a proper combination of technical means disclosed in different embodiments is encompassed in the technical scope of the present invention.

Note that, the present invention is applicable to a fixing device provided in an electrophotographic image forming apparatus such as a printer, a copying machine, a facsimile, an MFP (Multi Function Printer), and the like.

What is claimed is:

1. A fixing apparatus, comprising:

a fixing member and a pressing member, at least one of which is a heated member; and an external heating device which (i) heats a belt rotatably suspended by a plurality of support rollers, at least one of which includes therein a heat source and (ii) causes the belt to contact a peripheral surface of at least one of the fixing member and the pressing member to heat the heated member, the fixing member and the pressing member sandwiching and transporting a recording material so that an unfixed image on the recording material is fixed on the recording material, the fixing apparatus, further comprising a regulating member which (i) is provided outside, in an axis direction of the support roller, a facing portion of the support roller which portion faces the heated member, and (ii) contacts a side portion of the belt to regulate the position of the belt in the axis direction, the belt including a base material made of polyimide having a tensile strength of 300 MPa or more and a thickness of 50 μm to 200 μm, and a releasing layer on a surface of the base material, and in the base material, 5 to 25 parts by weight of graphite being dispersed in 100 parts by weight of polyimide.

2. The fixing apparatus as set forth in claim 1, wherein the regulating member is either rotatable in a rotational direction of the belt or movable in the axis direction of the support roller independently from the support roller.

3. The fixing apparatus as set forth in claim 1, further comprising:

temperature detecting means for detecting temperature of the belt; and temperature control means for controlling the temperature of the belt on the basis of a detection of the temperature detecting means, the releasing layer of the belt including fluorocarbon resin, when a developer whose melting point is from 100° C. to 140° C. is used to develop the unfixed image, the temperature control means operating so that the temperature of the belt during a rotation operation becomes 30° C. or more lower than a melting point of the fluorocarbon resin and also becomes 20° C. or more higher than a set temperature of the heated member.

4. The fixing apparatus as set forth in claim 1, further comprising release/contact operating means for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position, relative positions of the plurality of support rollers being fixed.

5. The fixing apparatus as set forth in claim 4, further comprising release/contact operating control means for controlling an operation of the release/contact operating means to control heat supplied from the external heating device to the heated member.

6. The fixing apparatus as set forth in claim 5, wherein the release/contact operating control means controls the operation of the release/contact operating means in accordance with a temperature condition of the heated member, a type of the recording material or an image formation mode.

7. The fixing apparatus as set forth in claim 1, further comprising rotation control means for controlling a rotation of the heated member, the belt being rotated by the rotation of the heated member.

8. The fixing apparatus as set forth in claim 7, wherein a contact force of the support roller contacting the heated member via the belt is from 0.25 N to 5 N per 1 cm of each support roller.

9. The fixing apparatus as set forth in claim 1, wherein a relation among (i) an internal diameter d0 of the belt, (ii) an external diameter d1 of the support roller whose angle formed between an external peripheral surface contacting the belt and a center of the support roller in a cross section of the support roller is largest among the support rollers, and (iii) an external diameter d2 of the heated member is represented by $\frac{1}{3} \times d2 \leqq d0 \leqq 3 \times d1$.

10. The fixing apparatus as set forth in claim 7, wherein the belt starts being rotated when the temperature of the belt is 150° C. or more.

11. The fixing apparatus as set forth in claim 1, wherein a material composition of the regulating member is different from a material composition of the belt.

12. The fixing apparatus as set forth in claim 1, wherein a material composition of a bearing of each of the support rollers is different from a material composition of the regulating member.

13. An image forming apparatus, comprising a fixing apparatus, the fixing apparatus, comprising:

a fixing member and a pressing member, at least one of which is a heated member; and an external heating device which (i) heats a belt rotatably suspended by a plurality of support rollers, at least one of which includes therein a heat source and (ii) causes the belt to contact a peripheral surface of at least one of the fixing member and the pressing member to heat the heated member, the fixing member and the pressing member sandwiching and transporting a recording material so that an unfixed image on the recording material is fixed on the recording material, the fixing apparatus, further comprising a regulating member which (i) is provided outside, in an axis direction of the support roller, a facing portion of the support roller which portion faces the heated member, and (ii) contacts a side portion of the belt to regulate the position of the belt in the axis direction, the belt including a base material made of polyimide having a tensile strength of 300 MPa or more and a thickness of 50 μm to 200 μm, and a releasing layer on a surface of the base material, and in the base material, 5 to 25 parts by weight of graphite being dispersed in 100 parts by weight of polyimide.

* * * * *